US011871802B1

(12) United States Patent
Izadjoo et al.

(10) Patent No.: US 11,871,802 B1
(45) Date of Patent: Jan. 16, 2024

(54) PLEATING SPACER AND ITS USE TO PROVIDE IMPROVED FACIAL MASKS AND RESPIRATORS

(71) Applicant: Integrated Pharma Services, LLC, Rockville, MD (US)

(72) Inventors: Parviz Izadjoo, Rockville, MD (US); Mina Izadjoo, Rockville, MD (US)

(73) Assignee: Integrated Pharma Services, LLC, Rockville, MD (US)

( * ) Notice: Subject to any disclaimer, the term of this patent is extended or adjusted under 35 U.S.C. 154(b) by 0 days.

(21) Appl. No.: 18/316,085

(22) Filed: May 11, 2023

Related U.S. Application Data

(60) Provisional application No. 63/398,787, filed on Aug. 17, 2022.

(51) Int. Cl.
*A41D 13/00* (2006.01)
*A41D 13/11* (2006.01)

(52) U.S. Cl.
CPC ..... *A41D 13/1115* (2013.01)

(58) Field of Classification Search
CPC ..... A41D 13/1115; A41D 2300/20; A41D 2300/22; A41D 2300/24;
(Continued)

(56) References Cited

U.S. PATENT DOCUMENTS 2,290,885 A * 7/1942 Lehmberg ..... A41D 13/1192 128/206.16
4,215,682 A 8/1980 Kubik et al.
(Continued)

FOREIGN PATENT DOCUMENTS

EP 0149590 7/1985
WO WO 2008/109438 9/2008
(Continued)

OTHER PUBLICATIONS

Machine translation of written description and claims for WO2022240034A1 via espacenet (Year: 2022).*
(Continued)

*Primary Examiner* — Margaret M Luarca
*Assistant Examiner* — Tyler A Raubenstraw
(74) *Attorney, Agent, or Firm* — Jeffrey I. Auerbach; Auerbach, LLC

(57) ABSTRACT

The present invention relates to improved protective pleated facial masks or respirators that comprise a pleating spacer that is adapted to enter into, and stably separate the folds of one or more of pleats of a pre-pleated mask or respirator filter, or a pre-pleated filter layer thereof. The present invention also relates to improved protective pleated facial masks or respirators that comprise a pleating spacer that is adapted to stably form one or more pleats in an initially unpleated filter of a facial mask or respirator, or a filter layer thereof. The pleating spacers of the present invention thus act to increase the effective surface area of the filters of such masks or respirators, and thereby improve airflow while preserving the ability of the mask or respirator to protect the wearer from hazardous agents. The invention also pertains to such pleating spacers, and particularly pertains to the use of such pleated facial masks or respirators to protect the wearer from particulates such as dust or other airborne debris, chemical agents, and/or biological agents (e.g., bacteria, fungi, and viruses) from air being inhaled or exhaled by the wearer.

19 Claims, 13 Drawing Sheets

(58) Field of Classification Search
CPC ..... A41D 13/11–1192; A41D 13/1107; A62B 7/10; A62B 23/00; A62B 23/02; A62B 23/025; A62B 18/00–10
See application file for complete search history.

(56) References Cited

U.S. PATENT DOCUMENTS 4,375,718 A 3/1983 Wadsworth et al.
4,592,815 A 6/1986 Nakao
4,630,604 A * 12/1986 Montesi ..... A41D 13/1146 128/206.17
4,874,659 A 10/1989 Katsutoshi et al.
5,401,446 A 3/1995 Tsai et al.
5,883,026 A 3/1999 Reader et al.
5,908,598 A 6/1999 Rousseau et al.
6,055,982 A * 5/2000 Brunson ..... A41D 13/1176 128/206.25
6,365,088 B1 4/2002 Knight
6,403,197 B1 * 6/2002 Skov ..... A62B 23/025 55/DIG. 35
7,210,482 B2 * 5/2007 Huang ..... A62B 23/025 128/206.13
8,091,550 B2 * 1/2012 Steindorf ..... A41D 13/11 128/206.16
8,276,588 B1 * 10/2012 Connor ..... A61M 16/06 128/206.26
8,851,068 B2 10/2014 Cohen et al.
10,238,158 B2 3/2019 Duffy
10,486,001 B1 * 11/2019 Bailey ..... A62B 23/025
10,668,308 B2 * 6/2020 Orofino ..... A62B 18/025
10,724,171 B2 7/2020 Schultz et al.
11,052,269 B1 * 7/2021 Greenway ..... B01D 39/1623
11,154,101 B2 10/2021 Karakostas
D952,133 S 5/2022 Cohen et al.
2003/0145858 A1 8/2003 Cardarelli
2005/0133034 A1 * 6/2005 Jensen ..... A41D 13/1115 128/206.13
2005/0139217 A1 * 6/2005 Chiam ..... A41D 13/1123 128/205.27
2006/0130214 A1 * 6/2006 Steindorf ..... A41D 13/1115 128/206.13
2006/0130841 A1 6/2006 Spence et al.
2007/0023046 A1 * 2/2007 Huang ..... A62B 18/025 128/206.12
2008/0011303 A1 1/2008 Angadjivand et al.
2009/0078261 A1 * 3/2009 Martin ..... A62B 23/025 29/428
2010/0154806 A1 * 6/2010 Duffy ..... A41D 13/1115 156/227
2010/0239625 A1 * 9/2010 Puckett ..... A41D 13/1115 424/402
2011/0067700 A1 * 3/2011 Spoo ..... A62B 23/025 128/206.19
2011/0308524 A1 12/2011 Brey et al.
2016/0296773 A1 * 10/2016 Lin ..... B01D 46/0032
2016/0338428 A1 * 11/2016 Duffy ..... A62B 18/02
2017/0120177 A1 5/2017 Hoder et al.
2017/0360125 A1 * 12/2017 Tuan ..... A41D 13/1115
2018/0008848 A1 * 1/2018 Moulton ..... A62B 18/025
2018/0133524 A1 * 5/2018 Jang ..... A62B 23/025
2018/0250537 A1 * 9/2018 Waterford ..... A62B 18/08
2018/0353782 A1 * 12/2018 Vasiliev ..... A62B 23/025
2019/0076680 A1 * 3/2019 Liu ..... A41D 13/1138
2020/0353296 A1 * 11/2020 Crenshaw ..... A62B 23/025
2021/0162243 A1 * 6/2021 Yang ..... A41D 31/12
2021/0274863 A1 9/2021 Ram
2021/0298389 A1 * 9/2021 Filko ..... A62B 23/025
2021/0316165 A1 * 10/2021 Wu ..... A62B 23/025
2021/0321687 A1 * 10/2021 Tuan ..... A41D 13/1176
2021/0346728 A1 * 11/2021 Fischer ..... A41D 13/1115
2021/0352976 A1 * 11/2021 Law ..... A41D 13/1161
2021/0371905 A1 * 12/2021 Haselton ..... C12Q 1/6883
2022/0032096 A1 * 2/2022 Augustine ..... B01D 46/10
2022/0079263 A1 3/2022 Cohen et al.
2022/0126127 A1 * 4/2022 Chen ..... A62B 18/025
2022/0132951 A1 * 5/2022 Roy ..... A41D 13/1115 128/863
2022/0295920 A1 * 9/2022 Van Der Hoeven ..... A41D 13/1115
2022/0295922 A1 * 9/2022 Adkins ..... A41D 13/1115
2023/0165323 A1 * 6/2023 Warikata ..... A41D 13/1107 128/863
2023/0166131 A1 * 6/2023 Heyer ..... A62B 18/10 128/206.12
2023/0218932 A1 * 7/2023 Robertson ..... A62B 23/025 128/206.19

FOREIGN PATENT DOCUMENTS

WO WO-2009038934 A1 * 3/2009 ..... A62B 23/025
WO WO-2018033108 A1 * 2/2018 ..... A41D 13/1115
WO WO 2021/161068 8/2021
WO WO-2022240034 A1 * 11/2022

OTHER PUBLICATIONS

Adhikari, A. et al. (2018) "*Field Evaluation of N95 Filtering Facepiece Respirators on Construction Jobsites for Protection against Airborne Ultrafine Particles*," Int. J. Environ. Res. Public Health 15(9):1958:1-15.
Bandi, M.M. et al. (2021) "*Electrocharging Face Masks With Corona Discharge Treatment*," Proc. Math. Phys. Eng. Sci. 477(2251):20210062:1-28.
Chen, L. et al. (2020) "*An Overview of Functional Nanoparticles as Novel Emerging Antiviral Therapeutic Agents*." Mater. Sci. Eng. C. Mater. Biol. Appl. 112:110924:1-15.
Chughtai, A.A. et al. (2020) "*Effectiveness of Cloth Masks for Protection Against Severe Acute Respiratory Syndrome Coronavirus 2*," Emerg. Infect. Dis. 26(10):e200948:1-5.
Dbouk, T. et al. (2020) "*On Coughing and Airborne Droplet Transmission to Humans*," Phys. Fluids 32:053310:1-10.
Dbouk, T. et al. (2020) "*On Respiratory Droplets and Face Masks*," Phys. Fluids 32:063303:1-11.
Deng, W. et al. (2021) "*Masks for COVID-19*," Adv. Sci. (Weinh). 9(3):e2102189:1-30.
González-Henríquez, C.M. et al. (2019) "Antimicrobial Polymers for Additive Manufacturing," Int. J. Mol. Sci. 20(5):1210:1-27.
Gurunathan, S. et al. (2020) "*Antiviral Potential of Nanoparticles—Can Nanoparticles Fight Against Coronaviruses*?" Nanomaterials 10(9):1645:1-29.
Khayan, K. et al. (2019) "*Active Carbon Respiratory Masks as the Adsorbent of Toxic Gases in Ambient Air*," J. Toxicol. 5283971:1-8.
Kumar, P. et al. (2021) "*Reusable $MoS_2$-Modified Antibacterial Fabrics with Photothermal Disinfection Properties for Repurposing of Personal Protective Masks*," ACS Appl Mater Interfaces. 13(11):12912-12927:1-16.
Lai, A.C.K. et al. (2012) "*Effectiveness of Facemasks to Reduce Exposure Hazards for Airborne Infections Among General Populations*," J. R. Soc. Interface 9, 938-948.
Leung, N.H.L. et al. (2020) "*Respiratory Virus Shedding in Exhaled Breath and Efficacy of Face Masks*," Nat. Med. 26:676-680.
Leung, W.W.F. et al. (2020) "*Electrostatic Charged Nanofiber Filter for Filtering Airborne Novel Coronavirus (COVID-19) and Nano-Aerosols*," Sep. Purif. Technol. 250:116886:1-18.
Li, P. et al. (2010) "*A Polycationic Antimicrobial And Biocompatible Hydrogel With Microbe Membrane Suctioning Ability*," Nat. Mater. 10(2):149-156.
MacIntyre, C.R. et al. (2020) "A Rapid Systematic Review of the Efficacy of Face Masks and Respirators Against Coronaviruses and Other Respiratory Transmissible Viruses for the Community, Healthcare Workers and Sick Patients," Int. J. Nurs. Stud. 108:103629:1-6.
Mitra, A. et al. (2021) "*Evaluation of a Filtering Facepiece Respirator and a Pleated Particulate Respirator in Filtering Ultrafine Particles and Submicron Particles in Welding and Asphalt Plant Work Environments*," Int. J. Environ. Res. Public Health 18(12):6437:1-14.

(56) References Cited

OTHER PUBLICATIONS

Mitra, D. et al. (2019) "*Antimicrobial Copper-Based Materials and Coatings: Potential Multifaceted Biomedical Applications*," ACS Appl. Mater. Interfaces 12(19):21159-21182.

Nurmakanov, Y. et al. (2021) "*Structural and Chemical Modifications Towards High-Performance of Triboelectric Nanogenerators*," Nanoscale Res. Lett. 16(1):122:1-27.

Rhee, M.S.M. et al. (2021) "*Carbon Dioxide Increases With Face Masks but Remains Below Short-Term NIOSH Limits*," BMC Infect. Dis. 21(1):354:1-7.

Rosner, E. (2020) "*Adverse Effects of Prolonged Mask Use among Healthcare Professionals during COVID-19*," J. Infect. Dis. Epidemiol. 6:130:1-5.

Salati, H. et al. (2021) "*N95 Respirator Mask Breathing Leads to Excessive Carbon Dioxide Inhalation and Reduced Heat Transfer in a Human Nasal Cavity*," Phys. Fluids 33(8):081913:1-13.

Stadnytskyi, V. et al. (2020) "*The Airborne Lifetime of Small Speech Droplets and Their Potential Importance in SARS* COV-2 *Transmission*," Proc. Natl. Acad. Sci. (U.S.A.) 117:11875-11877.

Staymates, M. (2020) "*Flow Visualization of an N95 Respirator With and Without an Exhalation Valve Using Schlieren Imaging and Light Scattering*," Phys. Fluids 32:111703:1-5.

Stilianakis, N.I. et al. (2010) "*Dynamics of Infectious Disease Transmission by Inhalable Respiratory Droplets*," J. R. Soc. Interface 7:1355-1366.

Sunjaya, A.P. et al. (2020) "*Rationale for Universal Face Masks in Public Against COVID-19*," Respirology 25(7):678-679.

Wang, H. et al. (2022) "*Triboelectric Charging of Melt-Blown Non-woven Filters With High Filtration Efficiency*," Sci. Rep. 12(1):1146:1-9.

Weaver, G.H. (1919) "*Droplet Infection and Its Prevention by the Face Mask*," J. Infect. Dis. 24:218- 230.

PCT/US23/66899 International Search Report (2023) (5 pages).

PCT/US23/66899 Written Opinion (2023) (6 pages).

PCT/US23/66899 PCT Recordation of Search History (18 pages).

* cited by examiner

PLEATING SPACER AND ITS USE TO PROVIDE IMPROVED FACIAL MASKS AND RESPIRATORS

CROSS-REFERENCE TO RELATED APPLICATIONS

This application claims priority to U.S. Provisional Patent Application Ser. No. 63/398,787 (filed Aug. 17, 2022; pending), which application is herein incorporated by reference in its entirety.

FIELD OF THE INVENTION:

The present invention relates to improved protective pleated facial masks or respirators that comprise a pleating spacer that is adapted to enter into, and stably separate the folds of one or more of pleats of a pre-pleated mask or respirator filter, or a pre-pleated filter layer thereof. The present invention also relates to improved protective pleated facial masks or respirators that comprise a pleating spacer that is adapted to stably form one or more pleats in an initially unpleated filter of a facial mask or respirator, or a filter layer thereof. The pleating spacers of the present invention thus act to increase the effective surface area of the filters of such masks or respirators, and thereby improve airflow while preserving the ability of the mask or respirator to protect the wearer from hazardous agents. The invention also pertains to such pleating spacers, and particularly pertains to the use of such pleated facial masks or respirators to protect the wearer from particulates such as dust or other airborne debris, chemical agents, and/or biological agents (e.g., bacteria, fungi, and viruses) from air being inhaled or exhaled by the wearer.

BACKGROUND OF THE INVENTION:

Protective face masks are extensively used to provide protection from airborne particulates, including dust or other airborne debris, chemical agents, and/or biological agents. Historically, such face masks extend from the bridge of the nose to the chin, and include a plurality of layers of opaque woven or non-woven filter media that totally block the ability to see the mouth and nose of the wearer. Protective face masks are described in, for example: U.S. Pat. No. 11,154,101; U.S. Pat. No. 11,052,269, U.S. Pat. No. 10,668,308; U.S. Pat. No. 10,238,158, U.S. 8,851,068; US D952,133; US 2022/0079263; US 2021/0274863; US 2010/0239625; US 2008/0011303; US 2006/0130841; US 2003/0145858; WO 2021/161068; and WO 2008/109438.

The SARS-CoV-2 virus and other human respiratory infectious diseases are currently understood to spread predominantly via respiratory droplets (Stadnytskyi, V. et al. (2020) "*The Airborne Lifetime Of Small Speech Droplets And Their Potential Importance In SARS CoV-2 Transmission*," Proc. Natl. Acad. Sci. (U.S.A.) 117:11875-11877; Dbouk, T. et al. (2020) "*On Coughing And Airborne Droplet Transmission To Humans*," Phys. Fluids 32:053310; Stilianakis, N. I. et al. (2010) "*Dynamics Of Infectious Disease Transmission By Inhalable Respiratory Droplets*," J. R. Soc. Interface 7:1355-1366; Staymates, M. (2020) "*Flow Visualization Of An N95 Respirator With And Without An Exhalation Valve Using Schlieren Imaging And Light Scattering*," Phys. Fluids 32:111703). The literature shows the efficacy of masks and face coverings dating back to the 1918 influenza pandemic (Weaver, G. H. (1919) "*Droplet Infection And Its Prevention By The Face Mask*," J. Infect. Dis. 24:218-230; Lai, A. C. K. et al. (2012) "*Effectiveness Of Facemasks To Reduce Exposure Hazards For Airborne Infections Among General Populations*," J. R. Soc. Interface 9, 938-948 (2012); Dbouk, T. et al. (2020) "*On Respiratory Droplets And Face Masks*," Phys. Fluids 32:063303; Leung, N. H. L. et al. (2020) "*Respiratory Virus Shedding In Exhaled Breath And Efficacy Of Face Masks*," Nat. Med. 26:676-680). In light of these observations, the U.S. Centers for Disease Control and Prevention (CDC) has recommended the use of face coverings to help slow the spread of COVID-19.

Unfortunately, typical cloth masks are generally ineffective in preventing the spread of the microdroplets associated with the spread of SARS-CoV-2, the causal agent of COVID-19, or the spread of other airborne pathogens (Chughtai, A. A. et al. (2020) "*Effectiveness of Cloth Masks for Protection Against Severe Acute Respiratory Syndrome Coronavirus* 2," Emerg. Infect. Dis. 26(10):e200948; Sunjaya, A. P. et al. (2020) "*Rationale For Universal Face Masks In Public Against COVID*-19," Respirology 25(7):678-679). Thus, health practitioners have advocated that the public wear more protective face masks in order to protect against such diseases.

Currently, the most effective protective face masks are the N95™ (or N99™) respirator masks, which incorporate polypropylene non-woven fibers to filter at least 95% (or at least 99%) of airborne particles. However, these masks are not designed to be worn for extended periods and cannot filter out all airborne particles nor filter out all airborne germs or viruses. Indeed, light-headedness, headache, and high blood pressure are symptoms that have been observed after wearing an N95 mask, and appear to be associated with shortness of fresh air for inhalation (Salati, H. et al. (2021) "N95 *Respirator Mask Breathing Leads To Excessive Carbon Dioxide Inhalation And Reduced Heat Transfer In A Human Nasal Cavity*," Phys. Fluids 33(8):081913:1-13; Rhee, M. S .M. et al. (2021) "*Carbon Dioxide Increases With Face Masks But Remains Below Short-Term NIOSH Limits*," BMC Infect. Dis. 21(1):354:1-7). In one study, more than 75% of healthcare professionals reported experiencing headaches after wearing a respirator for more than 3 hours, with nearly half of such healthcare professionals reporting headaches after wearing a respirator for 3 hours; more than 15% of such healthcare professionals reported experiencing headaches after even less than 1 hour. Nearly one quarter of such healthcare professionals reported that wearing a respirator resulted in impaired cognition (Rosner, E. (2020) "*Adverse Effects of Prolonged Mask Use among Healthcare Professionals during COVID*-19," J. Infect. Dis. Epidemiol. 6:130:1-5).

Standard pleated filters such as those used in HVAC systems, are made of rigid filtering materials or if soft, are held by structural support to prevent them from folding on each other. These types of filtering device will have a set depth throughout the entire device depending on the pleats size. The standard pleated filters may not be suitable when the depth of filtering device is restricted or not desirable. Existing technology uses either non-pleated (flat) filters such as those used in respirators, or rigid pleated filtration materials such as those used in HVAC systems. The non-pleated (flat) filters have less filtration surface compared to pleated types. To increase airflow through any type of filter, the overall surface area of the filter material must be increased. In the flat type filters, the size of the device will proportionally increase when the filter surface area is increased. In pleated type filters, the depth of the device will increase in proportion to the pleat size. This invention will keep the device depth to a minimum while the relatively large pleats are used. As a result, the surface area of the filter may be increased to achieve improved airflow without increasing the device dimensions (depth, width, length or diameter).

A need therefore remains for respirator masks that are capable of mediating effective filtration (e.g., N95™ or N99™ filtration) of particulates, chemical agents, and/or biological agents from air being inhaled or exhaled by the wearer while additionally providing sufficient breathability to permit wearers to employ the respirator masks for extended periods of time. The present invention is directed to this and other goals.

SUMMARY OF THE INVENTION:

The present invention relates to improved protective pleated facial masks or respirators that comprise a pleating spacer that is adapted to enter into, and stably separate the folds of one or more of the pleats of the filter of such masks and respirators, or a filter layer thereof. The present invention also relates to improved protective pleated facial masks or respirators that comprise a pleating spacer that is adapted to stably form one or more pleats in an initially unpleated filter of a facial mask or respirator, or a filter layer thereof. The pleating spacers of the present invention thus act to increase the effective surface area of the filters of such masks or respirators, and thereby improve airflow while preserving the ability of the mask or respirator to protect the wearer from hazardous agents. The invention also pertains to such pleating spacers, and particularly pertains to the use of such pleated facial masks or respirators to protect the wearer from particulates such as dust or other airborne debris, chemical agents, and/or biological agents (e.g., bacteria, fungi, and viruses) from air being inhaled or exhaled by the wearer.

In detail, the invention is directed to a pleating spacer of a pleated filter or filter layer of a respirator or facial mask, wherein the pleating spacer stabilizes the folds of the pleats, and increases the airflow through the respirator or facial mask in normal use and at normal pressure.

The invention is additionally directed to the embodiment of such pleating spacer wherein the pleating spacer is removeable and/or repositionable, and comprises an array of two or more fold separators, each fold separator of which extends outwardly from a spacer support backbone, wherein the spacing between adjacent fold separators of the array is adapted to permit the fold separators to be inserted into pleats of the pleated filter or filter layer of the respirator or facial mask.

The invention is additionally directed to the embodiment of such pleating spacers wherein the fold separators are prongs or springs that comprise a first and second end, of which only one end is attached to the pleating spacer.

The invention is additionally directed to the embodiment of such pleating spacers wherein the fold separators are loops that comprise a first and second end, both of which are attached to the pleating spacer.

The invention is additionally directed to the embodiment of such pleating spacers wherein the fold separators comprise a spiral, tubular, conical, or polyhedron shape.

The invention is additionally directed to a pleating spacer that comprises a rigid or semi-rigid support that is integrally positioned and/or affixed to the filter or filter layer, wherein the support comprises a preformed pleat-forming shape, and wherein the integral positioning and/or affixing of the pleating spacer causes the filter to form at least some of the pleats of the pleated filter.

The invention is additionally directed to the embodiment of such pleating spacers wherein the rigid or semi-rigid support comprises a one-dimensional support.

The invention is additionally directed to the embodiment of such pleating spacers wherein the one-dimensional support comprises a flat, tubular, or polyhedric support.

The invention is additionally directed to the embodiment of such pleating spacers wherein the rigid or semi-rigid support comprises a two-dimensional support.

The invention is additionally directed to the embodiment of such pleating spacers wherein the two-dimensional support comprises a mesh, screen, hole-containing surface, or sheet.

The invention additionally describes a pleated filter of a respirator or facial mask, comprising pleats that are stabilized by the removeable and/or repositionable pleating spacer of the above-described pleating spacers.

The invention additionally describes a pleated filter of a respirator or facial mask, comprising pleats that are caused by the integral positioning and/or affixing of the pleating spacer of the above-described integrally positioned and/or affixed pleating spacers.

The invention is additionally directed to the embodiment of any of the above-described pleating spacers or pleated filters, wherein the pleating spacer comprises plastic, a rigid or semi-rigid foam, nylon, Teflon®, rubber or a rubber copolymer, cardstock, paper, wood, silicone, or metal.

The invention is additionally directed to the embodiment of any of the above-described pleated filters wherein the pleated filter is an N95™ filter.

The invention is additionally directed to the embodiment of any of the above-described pleated filters, wherein the pleated filter is composed of multiple discreet layers.

The invention is additionally directed to the embodiment of any of the above-described pleated filters, wherein the pleated filter, or a filter layer thereof, is coated with an antimicrobial compound.

The invention is additionally directed to the embodiment of any of the above-described pleated filters, wherein the pleated filter is composed of at least one layer of a non-woven polypropylene fabric.

The invention is additionally directed to a respirator or facial mask, that comprises a respirator body adapted to be placed over the face or a wearer, wherein the respirator body comprises a pleated filter insert that comprises any of the above-described pleated filters.

The invention is additionally directed to the embodiment of the above-described respirator or facial mask wherein:

(a) the body comprises a solid support that comprises an opening having an internal edge and an opposing external edge;

(b) the opening of the body allows air communication between the external edge of the opening and the mouth and/or nose of the wearer; and (c) the pleated filter insert is removably mounted into a mating receiver on the external edge of the opening.

The invention is additionally directed to the embodiment of the above-described respirators or facial masks wherein the internal edge of the body is fitted to a gasketing layer capable of forming an air seal between an internal edge of the body and the wearer's face.

The invention is additionally directed to the embodiment of the above-described respirators or facial masks wherein the respirator or facial mask is an N95™ respirator or facial mask.

BRIEF DESCRIPTION OF THE DRAWINGS:

FIG. 1A illustrates a filter of the present invention comprising a pleated filter in concert with a pleating spacer. FIG. 1B illustrates a filter insert of the present invention comprising a pleated filter, a pleating spacer and an annular support ring that is adapted to mate to an opening of a respirator or facial mask.

FIGS. 2A-2C illustrate an embodiment in which the fold separators of such pleating spacers are prongs. FIG. 2A illustrates the filter-facing side of such a pleating spacer. FIG. 2B illustrates the pleating spacer from the opposing perspective, so that the non-filter-facing side of the spacer is visible. FIG. 2C illustrates how exemplary rows and columns of prongs may form a prong array of the preferred spacers of the invention. FIGS. 2D-2F illustrate an embodiment in which the fold separators of such pleating spacers are loops. FIG. 2D illustrates the filter-facing side of such a pleating spacer. FIG. 2E illustrates the pleating spacer from the opposing perspective, so that the non-filter-facing side of the spacer is visible. FIG. 2F illustrates how exemplary loops may form a loop array of the preferred spacers of the invention.

FIGS. 3A-3B show the interaction between a pleated filter or filter layer and the fold separators of a pleating spacer that comprises a prong array (such as that shown in FIGS. 2A-2C). FIG. 3B illustrates the interaction between the prongs and pleated filter or filter layer of the pleating spacer of FIG. 3A from an orthogonal perspective. FIG. 3C shows that the prongs of such pleating spacers extend outwardly from the spacer support backbone to form a pleat angle that is adapted to match the angle of the pleat fold of a pleated filter or filter layer. FIG. 3D shows the interaction between a pleated filter or filter layer and the fold separators of a pleating spacer that comprises a loop array (such as that shown in FIGS. 2D-2F).

FIG. 4A illustrates the embodiment in which the one-dimensional pleating spacer is integrally positioned or affixed to a filter (for example, with glue, melting, tabs, folds, magnets, etc.), to thereby cause the initially unpleated filter to adopt the shape of the pleating spacer, and form the desired pleated filter. FIG. 4B and FIG. 4C illustrate the embodiment from different views. FIG. 4D illustrates an alternative embodiment in which a one-dimensional pleating spacer is integrally positioned or affixed to a filter by being positioned between two filter materials, to thereby cause the initially unpleated filter to adopt the shape of the pleating spacer, and form the desired pleated filter.

FIG. 5A illustrates the embodiment in which the two-dimensional pleating spacer (shown as a mesh) is integrally positioned or affixed to the filter (for example, with glue, melting, tabs, folds, magnets, etc.), to thereby cause the initially unpleated filter to adopt the shape of the pleating spacer, and form the desired pleated filter. FIG. 5B and FIG. 5C illustrate the embodiment from different views. FIG. 5D illustrates an alternative embodiment in which a two-dimensional pleating spacer is integrally positioned or affixed to a filter by being positioned between two filter materials, to thereby cause the initially unpleated filter to adopt the shape of the pleating spacer, and form the desired pleated filter FIG. 6A illustrates the use of a pleating spacer to stably separate the pleats of a pre-pleated filter. FIG. 6B illustrates the use of a pleating spacer to form and stably separate pleats in an initially unpleated filter.

Figure 1A:
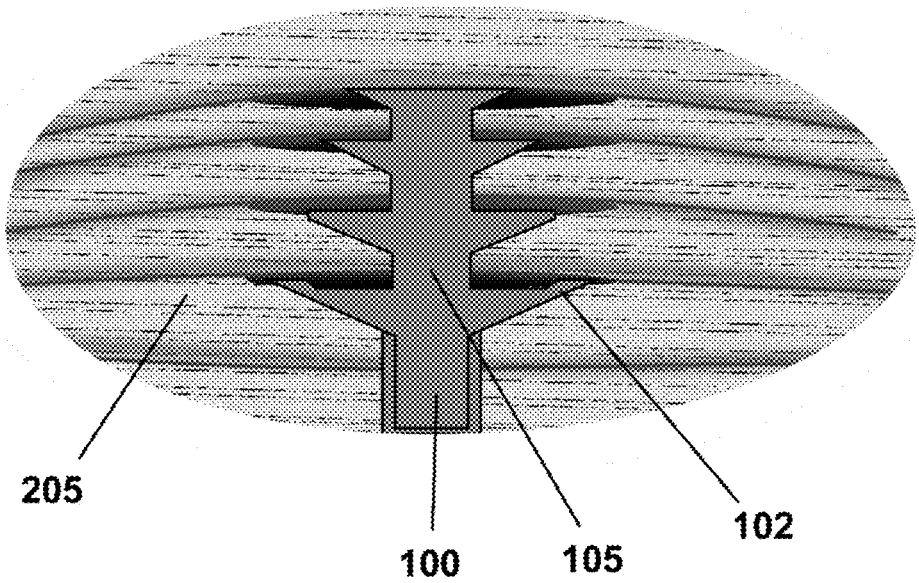
FIGS. 1A-1B illustrate filters of the present invention and the use of the pleating spacers of the invention.

DETAILED DESCRIPTION OF THE INVENTION:

The present invention relates to improved protective pleated facial masks or respirators that comprise a pleating spacer that is adapted to enter into, and stably separate the folds of one or more of pleats of a pre-pleated mask or respirator filter, or a pre-pleated filter layer thereof. The present invention also relates to improved protective pleated facial masks or respirators that comprise a pleating spacer that is adapted to stably form one or more pleats in an initially unpleated filter of a facial mask or respirator, or a filter layer thereof. The pleating spacers of the present invention thus act to increase the effective surface area of the filters of such masks or respirators, and thereby improve airflow while preserving the ability of the mask or respirator to protect the wearer from hazardous agents. The invention also pertains to such pleating spacers, and particularly pertains to the use of such pleated facial masks or respirators to protect the wearer from particulates such as dust or other airborne debris, chemical agents, and/or biological agents (e.g., bacteria, fungi, and viruses) from air being inhaled or exhaled by the wearer.

As used herein the term effective surface area is intended to denote the portion of the surface area of a filter through which air is capable of flowing in normal use and at normal pressure.

As used herein the terms "stably separates" and "stabilize" are intended to denote that a separation of pleat folds is maintained irrespective of movement by the wearer, and to distinguish a pleat fold separation that is merely transient, such as that caused by facial movement or by pulling on one portion of the pleated filter (i.e., an "un-stabilized" pleat). The invention thus significantly increases the surface area of filters without increasing the overall size of the filter device or its depth.

As used herein, the term "pre-pleated" with respect to a filter or filter layer, is intended to denote that the filter or filter layer comprises fold(s) that form one or more un-stabilized pleats therein prior to the presence, or introduction, of a "pleating spacer" of the present invention. As used herein, the term "pleating spacer" denotes a spacer that is capable of forming and supporting one or more pleats in an initially unpleated filter of a facial mask or respirator, or a filter layer thereof The presence, or introduction, of the pleating spacers of the present invention stabilize such un-stabilized pleats, or create new stabilized pleats therein. As used herein, the term "initially unpleated" with respect to a filter or filter layer, is intended to denote that the filter or filter layer substantially lacks pleats therein prior to the presence, or introduction, of a pleating spacer of the present invention. The presence, or introduction, of the pleating spacers of the present invention cause the initially unpleated filter to adopt the shape of the pleating spacer, and form the desired pleated filter.

As used herein, the term "dust or other airborne debris," is intended to denote coarse particles of greater than 1 μm in diameter, such as particles of soil, rock, etc. (see, e.g., Adhikari, A. et al. (2018) "*Field Evaluation of N95 Filtering Facepiece Respirators on Construction Jobsites for Protec-*

*tion against Airborne Ultrafine Particles*," Int. J. Environ. Res. Public Health 15(9):1958).

As used herein, the term "chemical agents" is intended to denote chemical odors, gases or vapors, such as ammonia, chlorine, hydrogen sulfide, COx, SOx, and NOx, etc. Such chemical agents are far too small to be directly filtered by the materials used to form the filters of N95™ or N99™ respirators, however, they may be filtered by respirators whose filters have been modified to contain adsorptive additives, such as charcoal, and activated carbon (see, e.g., Khayan, K. et al. (2019) "*Active Carbon Respiratory Masks as the Adsorbent of Toxic Gases in Ambient Air*," J. Toxicol. 5283971).

As used herein, the term "biological agents" is intended to denote pathogenic bacteria, fungi, and viruses, such as: *Bacillus anthracis* (the causal agent of anthrax), Bordetella pertussis (the causal agent of whooping cough (pertussis)), *Corynebacterium diphtherias* (the causal agent of diphtheria), Group A *streptococcus, Haemophilus influenzae* type b (a causal agent of meningitis and pneumonia), influenza virus (the causal agent influenza), *Legionella* bacteria (the causal agent of Legionnaires' disease and Pontiac fever), *Mycobacterium tuberculosis* (the causal agent of tuberculosis), poliovirus (the causal agent of poliomyelitis), Respiratory Syncytial Virus (RSV) (the causal agent of metapneumovirus infection), rubeola and rubella viruses (measles and German measles), SARS-CoV-2 (the causal agent of COVID-19), *Streptococcus pneumoniae* (a causal agent of pneumonia and meningitis), *varicella* (the causal agent of chickenpox), etc.

As used herein, the terms "mask," "face mask" and "facial mask" are intended to be synonymous, and to denote a fluid resistant facial barrier that comprises a filter that provides the wearer with protection against large droplets, splashes, or sprays of bodily or other hazardous fluids, and provides others with protection others from the wearer's respiratory emissions.

As used herein, the term "respirator" is intended to denote a type of face mask that forms a tight fitting to the wearer's mouth and nose. The tight fitting of the respirator and its filter are designed to permit the respirator to reduce the wearer's exposure to 95%, and more preferably 99%, of the undesired particulates (including small particle aerosols and large droplets) present in inhaled air (or to permit the respirator to trap the wearer's exhalation of such undesired particulates to a similar extent). N95 masks and N99 masks are examples of respirators of the present invention.

I. Preferred Filters of the Present Invention

The ability of a respirator to actually achieve its intended level of wearer protection requires balancing the competing need of permitting an adequate airflow to and from the wearer, with the need to simultaneously restrict airflow to an extent necessary to absorb and trap the required level of such particulates. Respirators address these concerns by incorporating a respirator filter, typically composed of a charged material capable of trapping airborne particulates. In order to increase surface area, respirators have been described that comprise folded filters (e.g., Mitra, A. et al. (2021) "*Evaluation of a Filtering Facepiece Respirator and a Pleated Particulate Respirator in Filtering Ultrafine Particles and Submicron Particles in Welding and Asphalt Plant Work Environments*," Int. J. Environ. Res. Public Health 18(12): 6437; 3M™ VFlex™ Particulate Respirator 9105, etc.).

The filters of the respirators of the present invention comprise surface portions that are substantially completely folded into wearer-repositionable pleats, such as those employed in surgical masks (e.g., U.S. Pat. No. 10,238,158; U.S. Pat. No. 10,668,308; U.S. Pat. No. 11,052,269, US 2006/0130841A1, etc.), as distinguished from masks having fixed "darts," as exemplified by U.S. Pat. No. 11,154,101, or flat-fold masks, as exemplified by US 2008/0011303A1.

The filters of the respirators of the present invention will preferably comprise a single filter layer, interposed between two external non-filter layers. In some embodiments, however, the filter layer may comprise 2, 3, 4, or more discreet filter layers, and in certain embodiments the filter may comprise 2, 3, 4, or more discreet non-filter layers, which may be all be external to the filter layer(s), or may be interleaved between one or more of such filter layer(s). The filter layer(s) of the filters of the present invention may be composed of any filtration material. Such materials include spun-bond or melt-blown fabrics, paper, or plastics (such as polypropylene (PP), polyethylene (PE), glass papers, woolen felt, cellulose, paper, etc.) fabricated from synthetic or natural polymers or composites (Deng, W. et al. (2021) "*Masks for COVID*-19," Adv. Sci. (Weinh). 9(3):e2102189). Melt-blown fabrics have three qualities that help make them particularly: thermal insulation, moisture resistance, and breathability (U.S. Pat. No. 11,052,269). Non-woven polypropylene fabric filters of the present invention may comprise, for example, microfibers comprising a diameter of from about 1 μm to about 10 μm, and may have a thickness of from about 100 μm to about 1000 μm, however, thinner or thicker filter layers may be employed. The filters of the respirators and masks of the present invention is/are preferably fabricated using non-woven melt-blown polypropylene, whereas the non-filter layers are preferably fabricated using spun-bond polypropylene, so as to cause the filter layer to possess smaller and denser fibers (and hence smaller voids) compared to the non-filter layers. The filters of the present invention may comprise additional one or more support layer(s) to enhance shape firmness, leak protection and/or filtration performance.

To improve filter performance, the filter layer of the filters of the present invention (or more than one of such filter layers, in embodiments having multiple filter layers) may be charged during fabrication with quasi-permanent dipoles called electrets to increase absorption and adherence of particulates (such as dust or other airborne debris), chemical agents, and/or biological agents (e.g., bacteria, fungi, viruses, etc.) from air being inhaled or exhaled by a user through the mechanism of electrostatic interaction (U.S. Pat. No. 4,215,682; U.S. Pat. No. 4,375,718; U.S. Pat. No. 4,592,815; U.S. Pat. No. 4,874,659; U.S. Pat. No. 5,401,446; U.S. Pat. No. 5,883,026; U.S. Pat. No. 5,908,598; U.S. Pat. No. 6,365,088; U.S. Pat. No. 10,724,171). Such charging may be accomplished using, for example, corona discharge, induction charging, triboelectric techniques, or other methods (Bandi, M. M. et al. (2021) "*Electrocharging Face Masks With Corona Discharge Treatment*," Proc. Math. Phys. Eng. Sci. 477(2251):20210062; Leung, W. W. F. et al. (2020) "*Electrostatic Charged Nanofiber Filter For Filtering Airborne Novel Coronavirus* (*COVID*-19) *And Nano Aerosols*," Sep. Purif. Technol. 250:116886; Wang, H. et al. (2022) "*Triboelectric Charging Of Melt Blown Non-woven Filters With High Filtration Efficiency*," Sci. Rep. 12(1): 1146; Nurmakanov, Y. et al. (2021) "*Structural and Chemical Modifications Towards High-Performance of Triboelectric Nanogenerators*," Nanoscale Res. Lett. 16(1):122).

In some embodiments, the filters of the respirators and masks of the present invention may comprise sheets coated with an antimicrobial compound, such as a salt (e.g., a quaternary ammonium salt (U.S. Pat. No. 11,052,269)), phosphonium, molybdenum disulfide (Kumar, P. et al. (2021) "*Reusable MoS2-Modified Antibacterial Fabrics with Photothermal Disinfection Properties for Repurposing of Personal Protective Masks*," ACS Appl Mater Interfaces. 13(11):12912-12927); a graphene material (e.g., a fullerene, graphite, graphene oxide, pristine graphene sheet, graphite oxide, etc.) capable, for example of disrupting the bacterial membrane, oxidative stress, and of facilitating the entrapment of micro-organisms (Deng, W. et al. (2021) "*Masks for COVID*-19," Adv. Sci. (Weinh). 9(3):e2102189); a polycationic hydrogel (e.g., a dimethyl-decyl ammonium chitosan-graft-poly(ethylene glycol)methacrylate poly(ethylene glycol)diacrylate) (Li, P. et al. (2010) "*A Polycationic Antimicrobial And Biocompatible Hydrogel With Microbe Membrane Suctioning Ability*," Nat. Mater. 10(2):149-156); metal particles/nanoparticles (e.g., particles of 1-10 nm diameter), such as particles and nanoparticles of gold, silver, copper, zinc, titanium, etc. and alloys thereof (e.g., bronze, brass, copper oxide, silver oxide, zinc oxide, titanium oxide, copper-nickel-zinc and cupronickel, etc.) (Deng, W. et al. (2021) "*Masks for COVID*-19," Adv. Sci. (Weinh). 9(3): e2102189; Mitra, D. et al. (2019) "*Antimicrobial Copper-Based Materials and Coatings: Potential Multifaceted Biomedical Applications*," ACS Appl. Mater. Interfaces 12(19): 21159-21182); bactericidal polymers and dendrimers (e.g., N-halamines, nitric oxide-containing polymers, etc.) (Gonzalez-Henriquez, C. M. et al. (2019) "*Antimicrobial Polymers for Additive Manufacturing*," Int. J. Mol. Sci. 20(5): 1210:1-27), or quantum dots (Gurunathan, S. et al. (2020) "*Antiviral Potential of Nanoparticles-Can Nanoparticles Fight Against Coronaviruses*?" Nanomaterials 10(9):1645; Chen, L. et al. (2020) "*An Overview Of Functional Nanoparticles As Novel Emerging Antiviral Therapeutic Agents*." Mater. Sci. Eng. C. Mater. Biol. Appl. 112:110924).

The pleats of the pleated filters of the present invention may be of any size (e.g., about 5 mm, about 10 mm, about 15 mm, about 20 mm, or more than about 20 mm). The filters of the present invention may comprise 1 or more such pleats, and will preferably comprise 5 or more pleats, such that the portion of the respirator fitting above the mouth and nose will be a pleated portion. The pleats may be in a single direction, or may comprise folds in opposing directions. The pleats of the pleated filters of the present invention may be folded so as to create a ridge line extending from the plane of the filter, or may be folded so as to create flat folded pleats that are substantially planar with the filter.

Figure 1B:
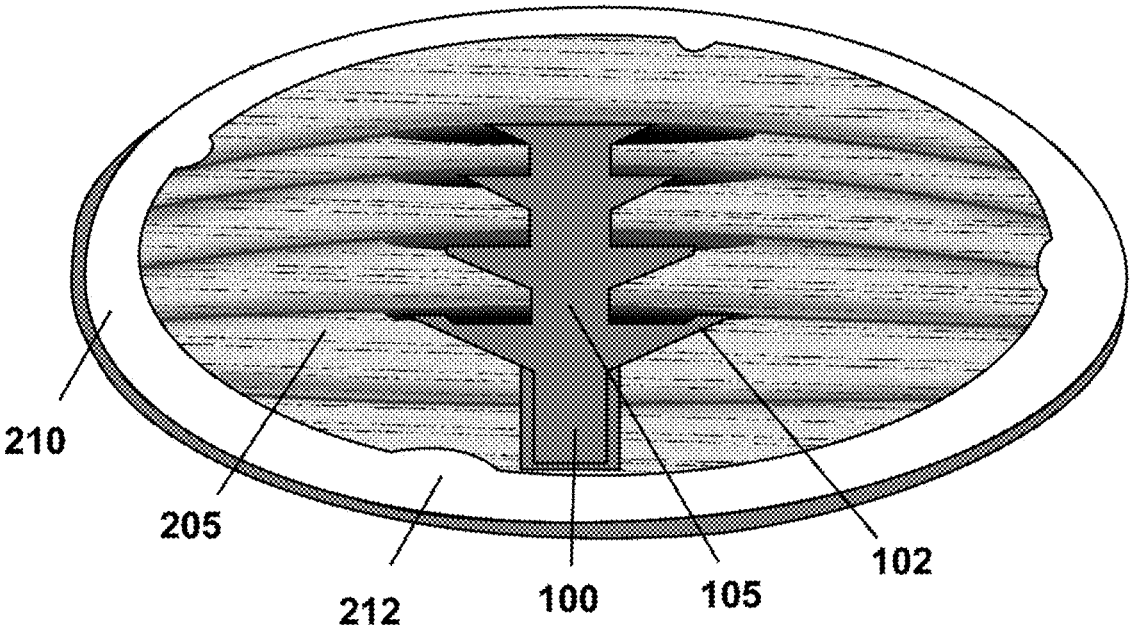

In one embodiment, the pleated filters or filter layers of the present invention will be mounted to a solid support so as to form a "filter insert" that is adapted to removably mate with the body of a respirator or facial mask. As used herein, the term "removably" is intended to denote a durable connection or fit between two components that does not spontaneously separate, but which permits the separation of such components from one another when desired. In one embodiment, the insert may comprise an above-described pleated filter or filter layer that is held by, or locked in place with a locking ring or annular plate that is adapted to engage with an annular filter support ring of a respirator body. FIG. 1A illustrates a filter of the present invention comprising a pleated filter in concert with a pleating spacer. In a second embodiment, the pleated filters or filter layers of the present invention will be shaped to fit into such a support, and will comprise a pleating spacer of the present invention, but will not include such a support. FIG. 1B illustrates a filter insert of the present invention comprising a pleated filter, a pleating spacer and an annular support ring that is adapted to mate to an opening of a respirator or facial mask.

II. Preferred Pleating Spacers of the Present Invention

A. Preferred Pleating Spacers for Stabilizing the Pleats of Pre-Pleated Filters In one embodiment, the pleating spacers of the present invention stably separate the folds of the pleats of a pre-pleated filter or filter layer. In one embodiment thereof, such pleating spacers are removeable and/or repositionable. Alternatively, such pleating spacers may be integrally positioned or affixed to the pre-pleated filter or filter layer.

1. Pleating Spacers of Pre-Pleated Filters That Comprise An Array Of Fold Separators In one embodiment, such pleating spacers are preferably removeable and/or repositionable, and are composed of an array of fold separators extending outwardly from the filter-facing side of a support backbone. In use, such fold separators are adapted to enter into, and partially separate the folds of a pleated respirator filter to thereby increase the effective surface area of the filter.

As used herein, the term "removeable," with respect to a pleating spacer, is intended to denote that the pleating spacer may be removed from a mask or respirator, and optionally replaced with another the pleating spacer without damaging the filter or a filter layer thereof. As used herein, the term "repositionable," with respect to a pleating spacer, is intended to denote that the pleating spacer may be moved or that its position may be adjusted, with respect to its placement in a mask or respirator, without damaging the filter thereof The support backbone of such pleating spacers is preferably fabricated from a flexible or semi-rigid material, so as to be sufficiently rigid to be inserted between the folds of a pre-pleated filter or filter layer, but not so rigid as to damage the filter or filter layer upon such insertion. Although any such material may be employed, it is preferable to employ a soft plastic material such as polyethylene (e.g., low density polyethylene, a polyethylene copolymer), a polyvinyl chloride plastic, a polyurethane (e.g., Ultrasint® TPU01, Ultrasint® TPU 88A, etc.), nylon, Teflon®, rubber or a rubber copolymer, silicone, or a flexible metal (e.g., copper, brass, silver, gold, stainless steel, iron, etc.) formed as a flexible strip, rod, dowel, coil spring, etc.) to fabricate the pleating spacers of the present invention. The support backbone of such pleating spacers of the present invention may alternatively be cardstock, ceramic, polypropylene (PP), polyethylene terephthalate (PET), polystyrene, acrylic plastic, polycarbonate, etc.), a rigid or semi-rigid foam (e.g., expanded polystyrene (EPS), extruded polystyrene (XPS), polyisocyanurate (Polyiso), polyurethane, etc.) etc. In embodiments of the invention, such pleating spacers may comprise multiple materials, for example, a plastic, silicone, rubber, foam, or other material, having an internal metal core, etc. The support backbone of the pleating spacer may have an open appearance, such as a mesh, a hole-containing surface, etc.) or may have a closed appearance.

As used herein, the term "fold separator" is intended to denote an extension of a pleating spacer that serves to separate the folds of a pleat of the pleated filter or filter layers of the present invention. A fold separator may comprise any geometry (e.g., spiral, tubular, conical, or polyhedron shape (e.g., a polyhedron having a base that is triangular, quadrilateral, pentagonal, hexagonal, etc.). The fold separators of the present invention may comprise prongs, loops, etc., having dimensions sized to fit into the folds of the pleats of a pre-pleated filter or filter layer. The fold separators of the present invention may be fabricated from any material that is sufficiently flexible to permit its insertion between pleat folds, including any of the above-mentioned soft plastic materials, nylon, Teflon®, rubber or a rubber copolymer, silicone, metal (e.g., copper, brass, silver, gold, stainless steel, iron, etc.) formed as a flexible strip, rod, dowel, coil spring, etc.), cardstock, etc. The fold separators of the present invention may be completely composed of such materials, or may be partially composed of such materials and a non-flexible material that does not prevent insertion of the fold separator of the present invention into the folds of a pleat of a pleated filter or filter layers of the present invention. Fold separators may be attached to the support backbone of the pleating spacers using any of a variety of methods (e.g., glue, melting, tabs, folds, magnets, etc.).

Insertion of the fold separators of such pleating spacer into the pleats of the pleated filter or filter layer stably separates the folds of the pleats. The pleating spacers can be made in different shapes and sizes depending on the filter type and pleat size. The pleating spacer provides structural support between the pleats allowing air to find its way through the pleated filter or filter layer resulting in increased airflow through the filter. The backbone of the pleating spacer may comprise decorations, logos, names, or images (e.g., school names and/or logos, sport team names and/or logos, corporate, organizational or event, names or logos, flags, etc.).

The pleating spacer may be inserted into pleats on only one side, or on both sides, of a pleated filter or filter layer. Employing a pair of pleating spacers to stably separate pleat folds on both sides of a pleated filter or filter layer provides the greatest enhancement to air flow and breathability, and is preferred. However, using pleating spacers to stably separate pleat folds on only one side of a pleated filter or filter layer may provide a substantial increase in air flow and breathability at lower cost and with lower manufacturing complexity.

In one embodiment, the fold separators of such removeable and/or repositionable pleating spacers of the present invention will comprise a straight or curved extension ("prongs"), having a first end that is attached to the support backbone and a second, and free, end that, in use, is inserted into the fold of a pleated filter or filter layer. The free end of the prong preferably terminates with a smooth cap or end, which facilitates the insertion of the prong into a pleat of the pleated filter or filter layer of the respirator or mask filter, and which serves to protect the filter from perforation or damage by the prong. In preferred embodiments, the rigidity of the spacer support backbone (100) is increased by the presence of a thickened edge (110). Friction between the pleat of the pleated filter or filter layer and the prong and cap secures the pleating spacer to the pleated filter or filter layer.

Figure 2A:
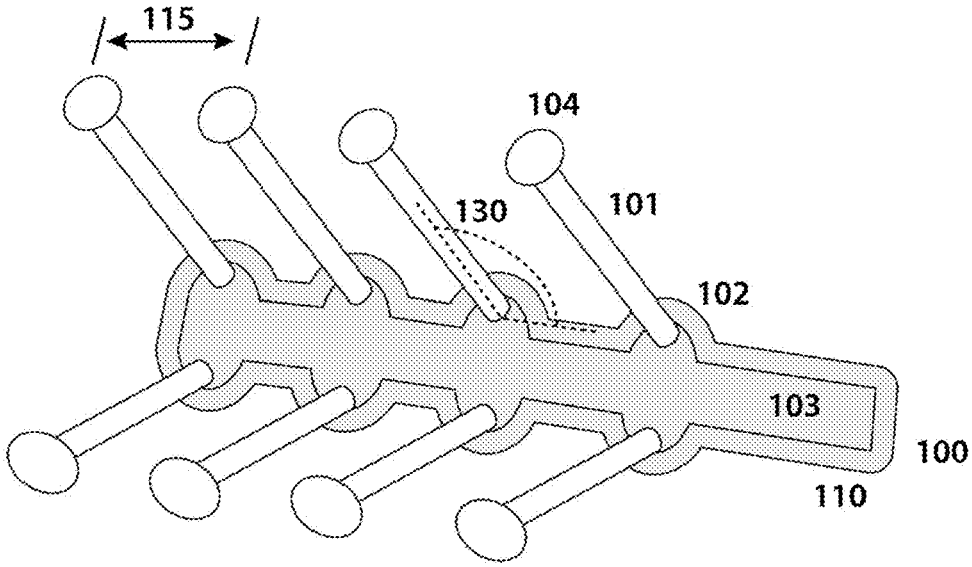
FIGS. 2A-2F illustrate embodiments of the preferred pleating spacers of the present invention.

FIG. 2A illustrates the filter-facing side of a removeable and/or repositionable pleating spacer of the present invention that comprises prongs as fold separators. As shown in FIG. 2A, in a preferred embodiment, a pleating spacer of the present invention may comprise a spacer support backbone (100) that supports an array of fold separators (101) (shown as prongs), each extending outwardly from locations (102) on the filter-facing side (103) of the spacer support backbone (100). Each row of fold separators (101) prongs is angled relative to the backbone (100) to form a pleat angle (130) that corresponds to the pleat angle of the folds of the pleats of the intended pleated filter or filter layer. The free end of the prongs terminates with a cap (104) suitable for facilitating insertion into the folds of a pleat of the pleated filter or filter layer. The cap (104) may be a smooth ellipsoid, ball or other structure, or may be more complex, such as the three-sided cap shown in FIG. 3C.

Figure 2B:
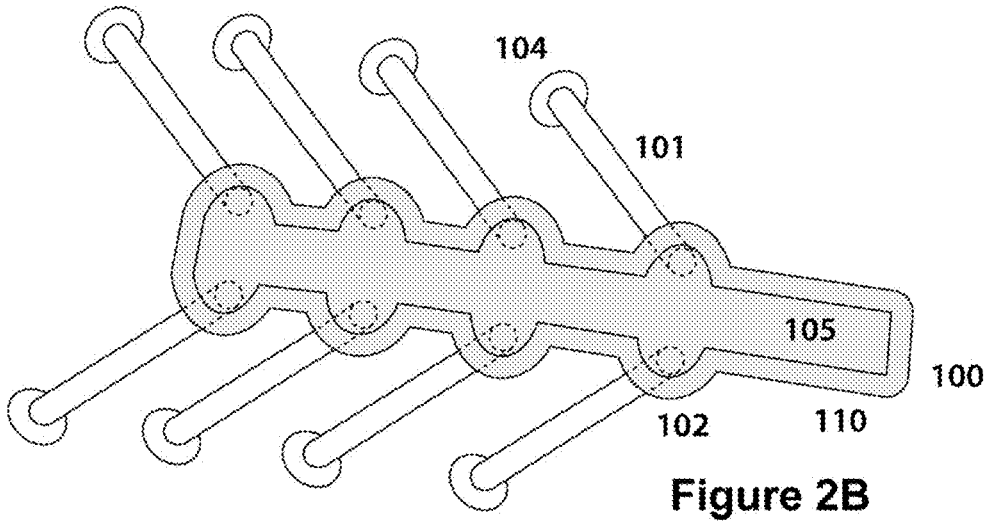
Figure 2C:
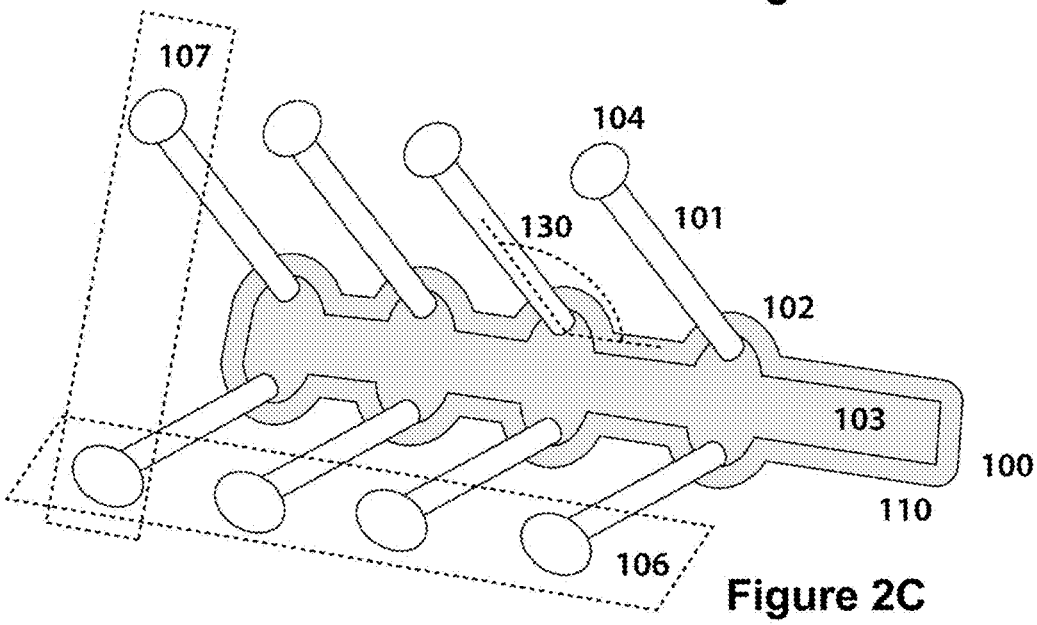
Figure 3A:
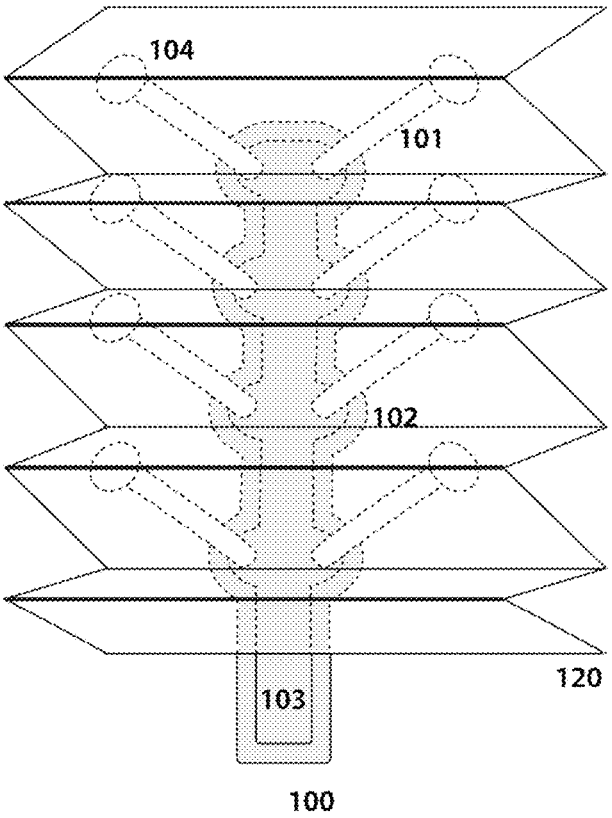
FIGS. 3A-3D illustrate the interaction between preferred pleating spacers of the invention and the pleats of the pleated filter or filter layer of the invention.

FIG. 2B illustrates a preferred embodiment of such removeable and/or repositionable pleating spacer of the present invention from the opposing perspective, so that the non-filter-facing side (105) of the spacer support backbone (100) is visible. As shown in FIG. 2C, the array of fold separators (101) (shown as prongs) is illustrated as comprising 2 columns (106) of 4 rows (107) of fold separator (101) prongs; such an array is merely for purposes of illustrating the invention, and is not intended to be limiting. The number of columns (106) may be greater than or less than 2; the number of rows (107) may independently be greater or less than 4. The distance (115) between adjacent rows of the prongs is preferably selected to permit the prongs of adjacent rows to be inserted into different, and preferably adjacent, pleats of the pleated filter or filter layer. In preferred embodiments, this distance is from about 10 mm to about 25 mm. FIG. 3A illustrates this concept.

Figure 3B:
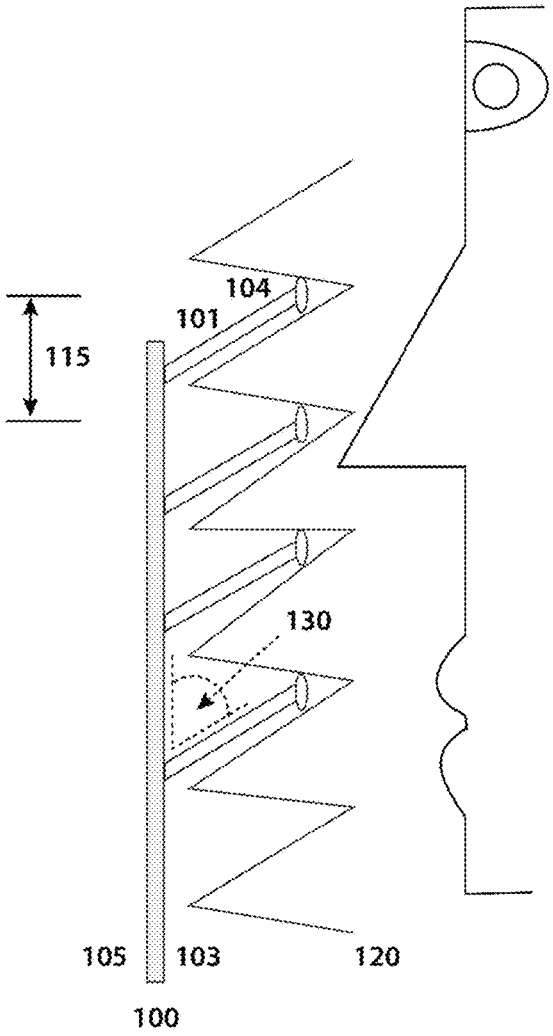
Figure 3C:
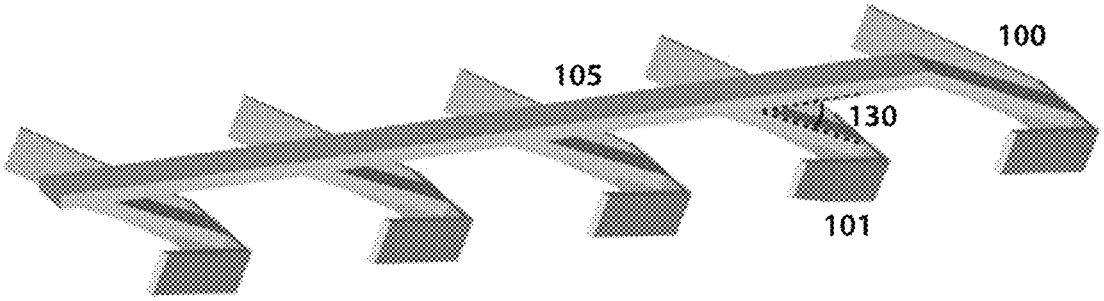

In FIG. 3A, the filter-facing side (103) of the spacer support backbone (100) is shown, with prongs as fold separators (101), each extending into a pleat of the pleated filter or filter layer (120) (pleat folds extending away from the spacer support backbone (100) are shown with a thicker line than that used to depict the pleat folds extending toward the spacer support backbone (100). FIG. 3B illustrates the interaction between the fold separator (101) prongs and pleated filter or filter layer (120) of FIG. 3A from an orthogonal perspective. The sizes shown and the extent of pleat folds are merely illustrative, and are not to be viewed as being substantive to the invention. FIG. 3C illustrates a pleating spacer that employs a prong fold separator possessing a three-sided cap (104) that comprises a central portion that is designed to be substantially parallel to the pleat, flanked by side wings that extend backwardly toward the spacer support backbone (100). The Figure shows the non-filter-facing side (105) of a spacer support backbone (100) that comprises a single column of fold separator (101) prongs. FIG. 3C shows that the fold separator (101) prongs preferably extend outwardly from the spacer support backbone (100) to form a pleat angle (130) that is adapted to match the angle of the pleat fold of a pleated filter or filter layer (120).

In a second embodiment, the fold separators of the removeable and/or repositionable pleating spacers of the present invention may comprise "loops" having first and second ends that are both attached to the support backbone; in use, such loop is inserted into the fold of a pleated filter or filter layer. Such prongs and loops may be either unbranched, or may have one or more branched portions extending therefrom.

Figure 2D:
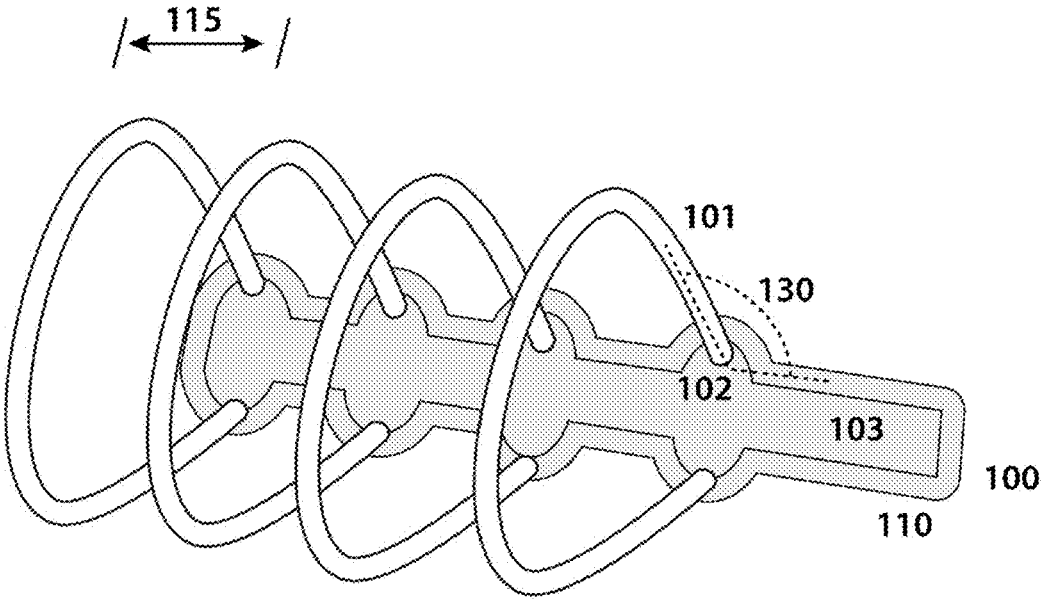

FIG. 2D illustrates the filter-facing side of a removeable and/or repositionable pleating spacer of the present invention that comprises loops as fold separators. As shown in FIG. 2D, in a preferred embodiment, a pleating spacer of the present invention may comprise a spacer support backbone (100) that supports an array of fold separators (101) (shown as loops), each extending outwardly from locations (102) on the filter-facing side (103) of the spacer support backbone (100), and then returning to the spacer support backbone (100). Each loop of the fold separator (101) is angled relative to the backbone (100) to form a pleat angle (130) that corresponds to the pleat angle of the folds of the pleats of the intended pleated filter or filter layer.

Figure 2E:
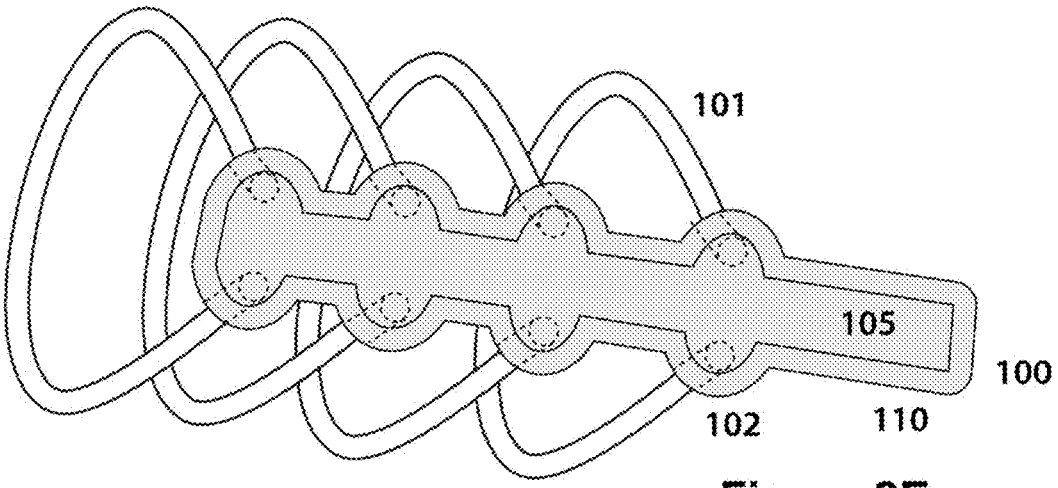
Figure 2F:
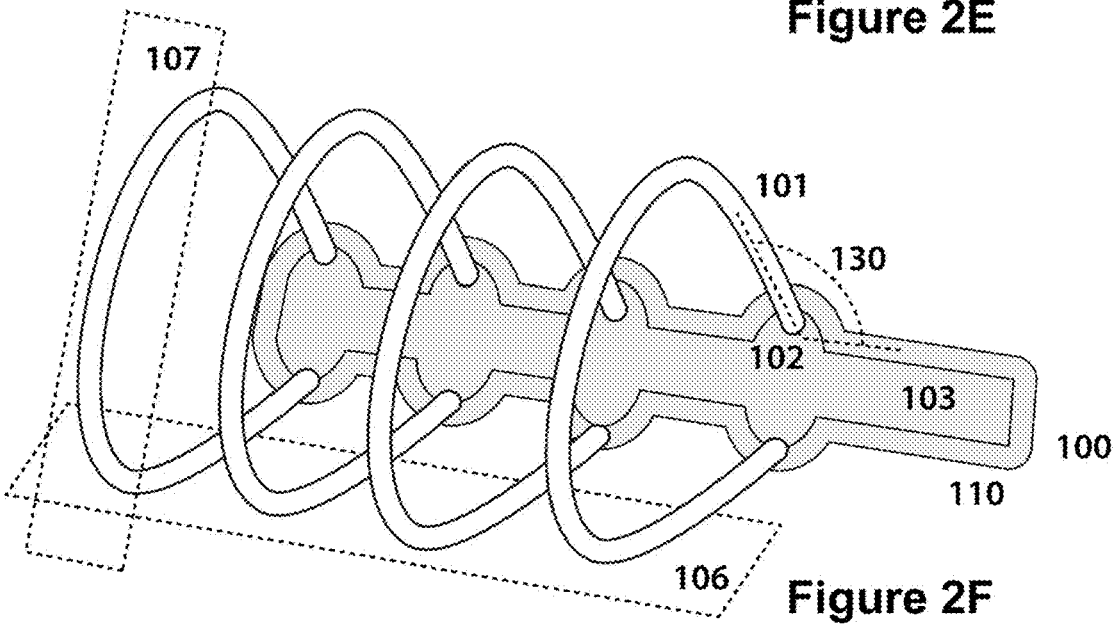
Figure 3D:
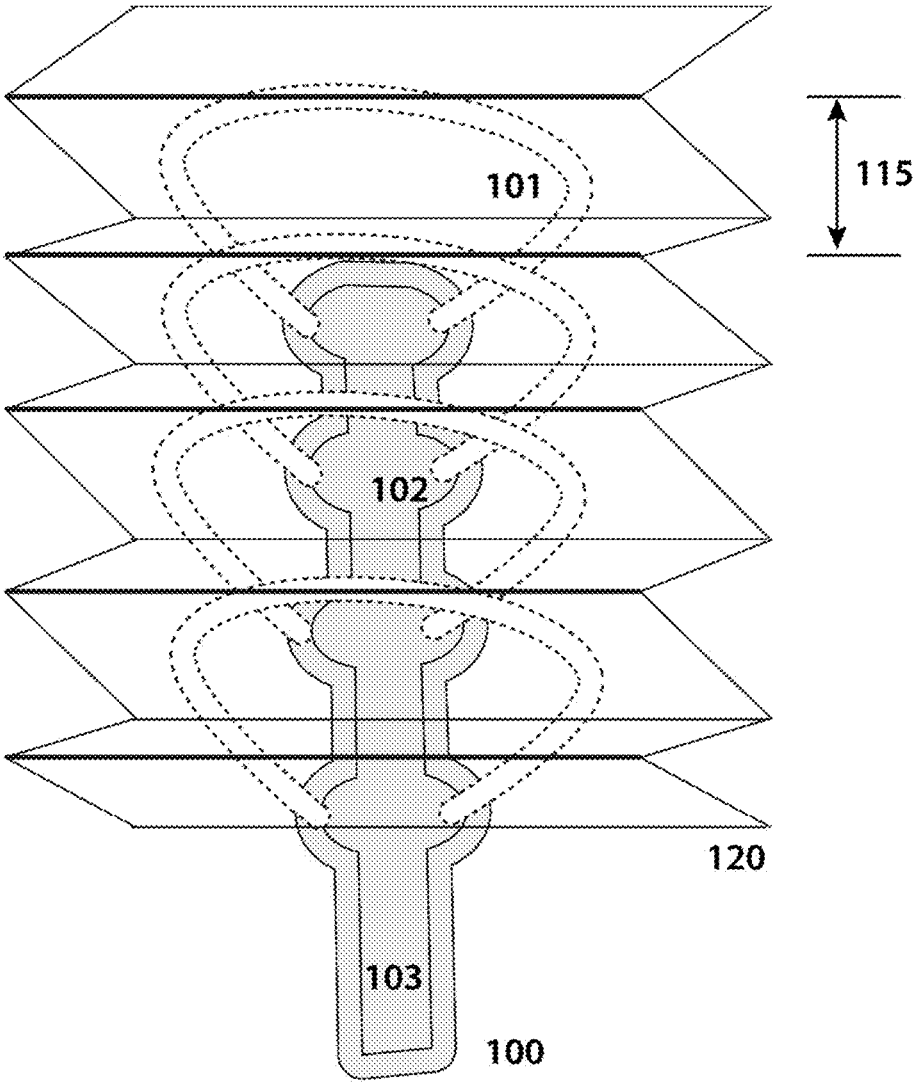

FIG. 2E illustrates a preferred embodiment of such removeable and/or repositionable pleating spacers of the present invention from the opposing perspective, so that the non-filter-facing side (105) of the spacer support backbone (100) is visible. As shown in FIG. 2F, the array of fold separators (101) (shown as loops) is illustrated as comprising a single column (106) of 4 rows (107) of fold separator (101) loops; such an array is merely for purposes of illustrating the invention, and is not intended to be limiting. The number of columns (106) may be greater than 1; the number of rows (107) may independently be greater or less than 4. The distance (115) between adjacent loops is preferably selected to permit adjacent loops to be inserted into different, and preferably adjacent, pleats of the pleated filter or filter layer. In preferred embodiments, this distance is from about 10 mm to about 25 mm. FIG. 3D illustrates this concept.

In FIG. 3D, the filter-facing side (103) of the spacer support backbone (100) of a removeable and/or repositionable pleating spacer is shown, with loops as fold separators (101), each extending into a pleat of the pleated filter or filter layer (120) (pleat folds extending away from the spacer support backbone (100) are shown with a thicker line than that used to depict the pleat folds extending toward the spacer support backbone (100).

In a further embodiment, the pleated filter may be removeable and/or repositionable and may be fully or partially pre-folded, or may be unfolded, and will be stably folded by the interaction of one or more first magnetic fasteners positioned on a fold separator so as to be able to contact a first side of the filter or filter layer, and one or more mating second magnetic fasteners positioned so as be capable of contacting the second side of the filter or filter layer. Such first side may be the side of the filter or filter layer facing the user, with the second side thereof facing outwardly, or the first side of the filter or filter layer may be the side of the filter or filter layer facing away from a user, with the second side thereof facing inwardly, toward the user. Attraction between such first and second magnets causes the filter or filter layer to stably fold into a pleated filter or filter layer that conforms to the shape of the fold separator. Such magnetic fasteners may have any geometry (i.e., circular, rectangular, etc.), and be of any dimension compatible with the dimensions of the filter or filter layer.

In a further embodiment, the pleated filter may be removeable and/or repositionable and may be fully or partially pre-folded, or may be unfolded, and will be stably folded by the interaction of one or more fastener portions positioned on a fold separator so as be able to contact a first side of the filter or filter layer, and one or more mating second fastener portions positioned on such first side of the filter or filter layer. Such first side may be either the side of the filter or filter layer facing the user, or the side of the filter or filter layer facing away from the user. Such mating fastener portions may comprise interacting portions of a snap, button or buttonhole, pin, adhesive-coated tape, disc, or area, hook and loop fastener, etc.) Interaction between such first and second fastener portions causes the filter or filter layer to stably fold into a pleated filter or filter layer that conforms to the shape of the fold separator. Such fasteners may have any geometry (i.e., circular, rectangular, etc.), and be of any dimension compatible with the dimensions of the filter or filter layer.

In a still further embodiment, the pleated filter may be removeable and/or repositionable and may be fully or partially pre-folded, or may be unfolded, and will be stably folded by the interaction between such filter or filter layer and a fold separator that comprises one or more fasteners such as a double-sided adhesive-coated tape, disc, or area, or hook and loop fastener portion capable of binding to the filter or filter layer, etc. Such fasteners may be positioned either on the side of the filter or filter layer facing the user, or on the side of the filter or filter layer facing away from the user. Interaction between the fastener and the filter or filter layer causes the filter or filter layer to stably fold into a pleated filter or filter layer of the present invention. Such fasteners may have any geometry (i.e., circular, rectangular, etc.), and be of any dimension compatible with the dimensions of the filter or filter layer.

2. Pleating Spacers of Pre-Pleated Filters That Comprise An Integrally Positioned Or Affixed Support In an alternative embodiment, the pleating spacers of a pre-pleated filter may comprise an integrally positioned or affixed support. Such supports may be one-dimensional, two-dimensional, or three-dimensional in shape, and are integrally positioned or affixed to stabilize the pleats of such pre-pleated filter or a layer thereof.

As used herein, with respect to the pleating spacers of the present invention, the term "one-dimensional" support is intended to denote a support that extends in a single axis, such as a linear wire, rod, dowel, stick, etc., and which is typically not connected to other one-dimensional pleating spacers of the pleating spacer. The term "two-dimensional" support, with respect to the such pleating spacers is intended to denote a support that extends in two axes, such as a mesh, screen, hole-containing surface, sheet, etc. The geometry of such two-dimensional pleating spacers is not critical to the invention. The two-dimensional pleating spacer is preferably bent, molded, cast, folded, or otherwise formed, so as to cause it to stabilize the pleats of the pre-pleated filter when integrally positioned or affixed to the filter material. In one embodiment, in which the overall size of the two-dimensional pleating spacer, relative to the surface area of the filter, is not so great as to significantly affect airflow through the filter, the two-dimensional pleating spacer may be solid (i.e., lacking holes or other openings). Preferably, however, the two-dimensional pleating spacer will comprise holes, pores, or other openings, so as to not unacceptably impede airflow through the filter. The term "three-dimensional" support is intended to denote a support that extends in three axes, for example, a three-dimensional mesh, screen, or hole-containing support, for example by being interposed between, and separating, two or more sheets of filter materials in filters that comprise such sheets. Such one-, two-, or three-dimensional pleating spacers may comprise decorations, logos, names, or images (e.g., school names and/or logos, sport team names and/or logos, corporate, organizational or event, names or logos, flags, etc.).

As used herein, the term "integrally positioned or affixed, " with respect to a pleating spacer, is intended to denote that the pleating spacers is not removeable or repositionable from the filter without damaging the filter or a filter layer thereof. In one embodiment, such integral positioning or affixing may be accomplished by fastening the spacer to the filter material (for example, by gluing, spot gluing, cross-linking, melting, tying, etc.). Alternatively, such integral positioning or affixing may be accomplished by positioning a pleating spacer between two layers of filter material that are then fixed to one another (for example, by gluing, spot gluing, cross-linking, melting, tying, etc.), or fixed to the pleating spacer, so as to trap the pleating spacer within the filter material. The integrally positioned or affixed pleating spacers of the present invention may be sized to extend across the entire surface of the filter, or may be sized to extend over only a portion of the surface of the filter.

Such one-, two-, or three-dimensional pleating spacers are preferably fabricated from a rigid or semi-rigid material, and are sufficiently rigid to possess a stable pleat-folding form that when positioned or affixed to the filter stabilizes the pleats of the filter. Suitable materials include thick paper or cardstock, plastic (e.g., polyethylene (e.g., low density polyethylene, a polyethylene copolymer), polypropylene (PP), polyethylene terephthalate (PET), a polyvinyl chloride plastic, a polyurethane (e.g., Ultrasint® TPU01, Ultrasint® TPU 88A, etc.), polystyrene, acrylic plastic, polycarbonate, etc.), a rigid or semi-rigid foam (e.g., expanded polystyrene (EPS), extruded polystyrene (XPS), polyisocyanurate (Polyiso), polyurethane, etc.), nylon, Teflon®, wood, rubber or a rubber copolymer, silicone, metal (e.g., copper, brass, silver, gold, stainless steel, iron, etc.) formed as a flexible strip, rod, dowel, coil spring, etc.), etc. In embodiments of the invention, the spacers may comprise multiple materials, for example, a flexible plastic, silicone, rubber, foam, or other material having an internal core (e.g., a solid or braded metal core, a set of beads, etc.).

The geometry of such one- or two-dimensional pleating spacers is not critical to the invention, and may be flat, tubular, polyhedric (e.g., a polyhedron having a base of 3, 4, 5, 6, or more than 6 sides), etc., and is preferably bent, molded, cast, folded, or otherwise formed, so as to cause it to stabilize the filter pleats when integrally positioned or affixed to the pre-pleated filter material.

B. Preferred Pleating Spacers for Forming Stabilized Pleats in Initially Unpleated Filters In an alternative embodiment, the pleating spacers of the present invention are used to form stabilized pleats in an initially unpleated filter or filter layer. In one embodiment thereof, such pleating spacers are removeable and/or repositionable, and will comprise clips, tabs, magnets, etc. capable of creating the desired pleats. Alternatively, and more preferably, such pleating spacers will comprise one or more one-dimensional, two-dimensional, or three-dimensional pleating spacers, as described above or combinations thereof, which may be removeable and/or repositionable, but are more preferably integrally positioned or affixed, to the initially unpleated filter or filter layer, to thereby form stabilized pleats in the initially unpleated filter or filter layer.

Figure 4A:
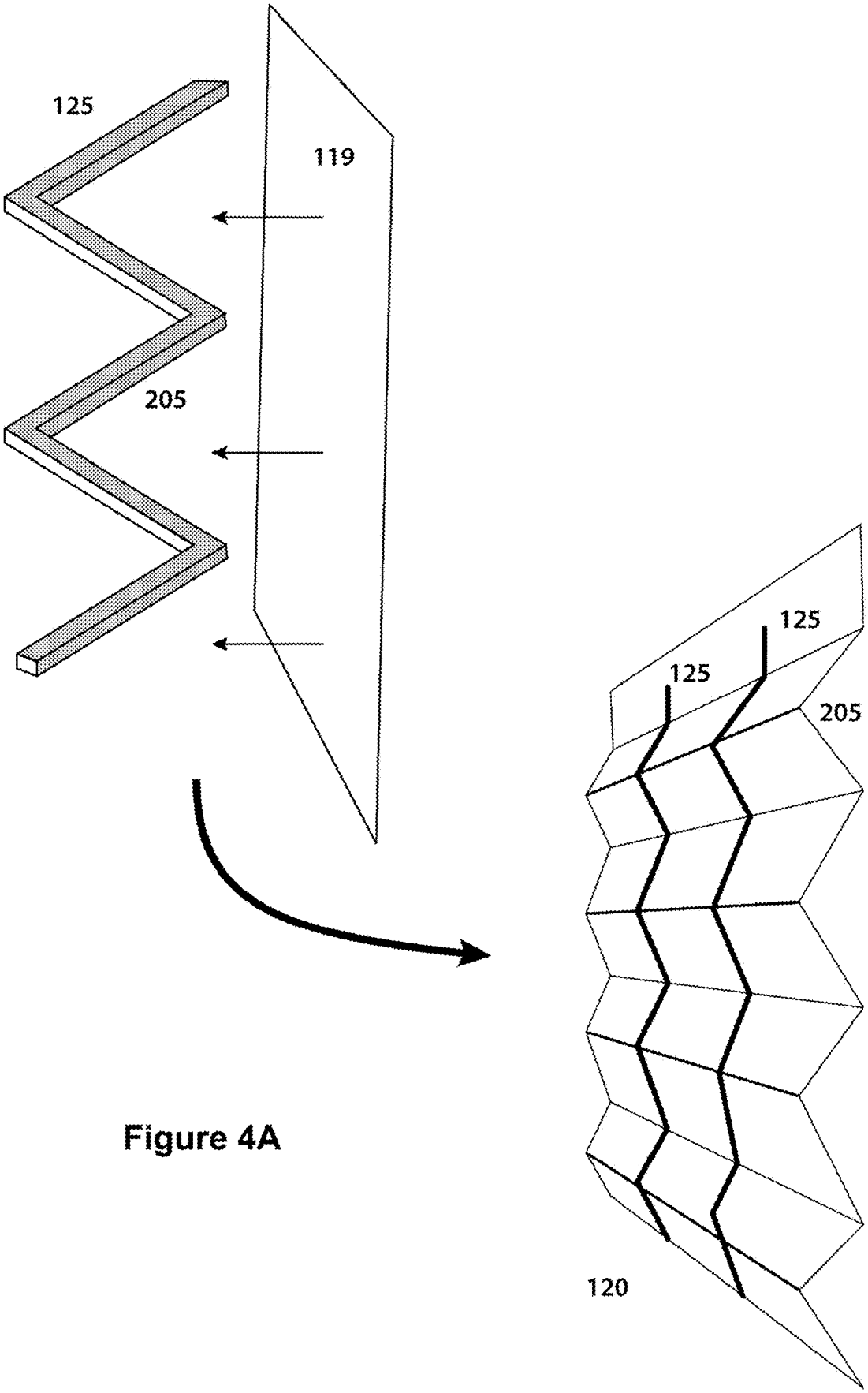
FIGS. 4A-4D illustrate the use of a one-dimensional pleating spacer to stably form a pleated filter from an initially unpleated filter.
Figure 4B:
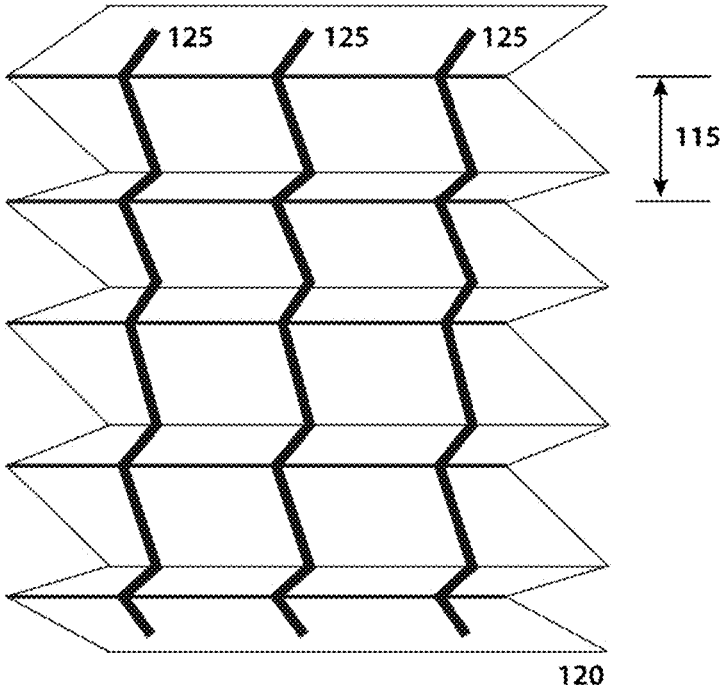
Figure 4C:
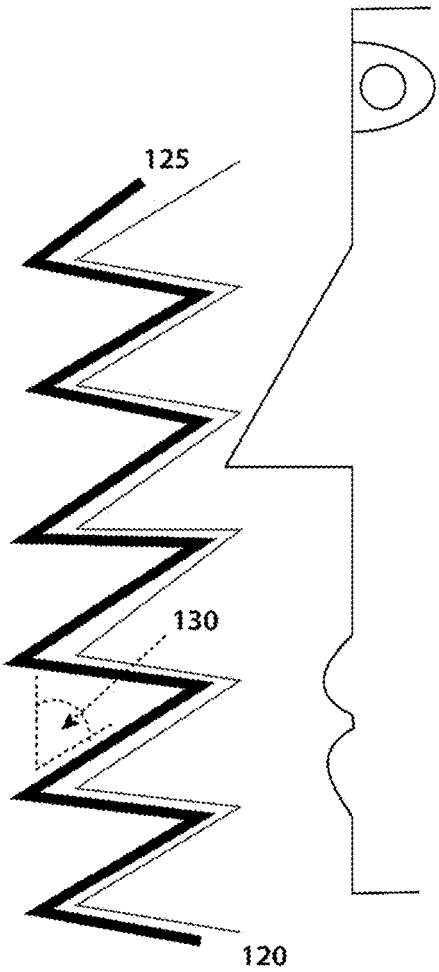
Figure 4D:
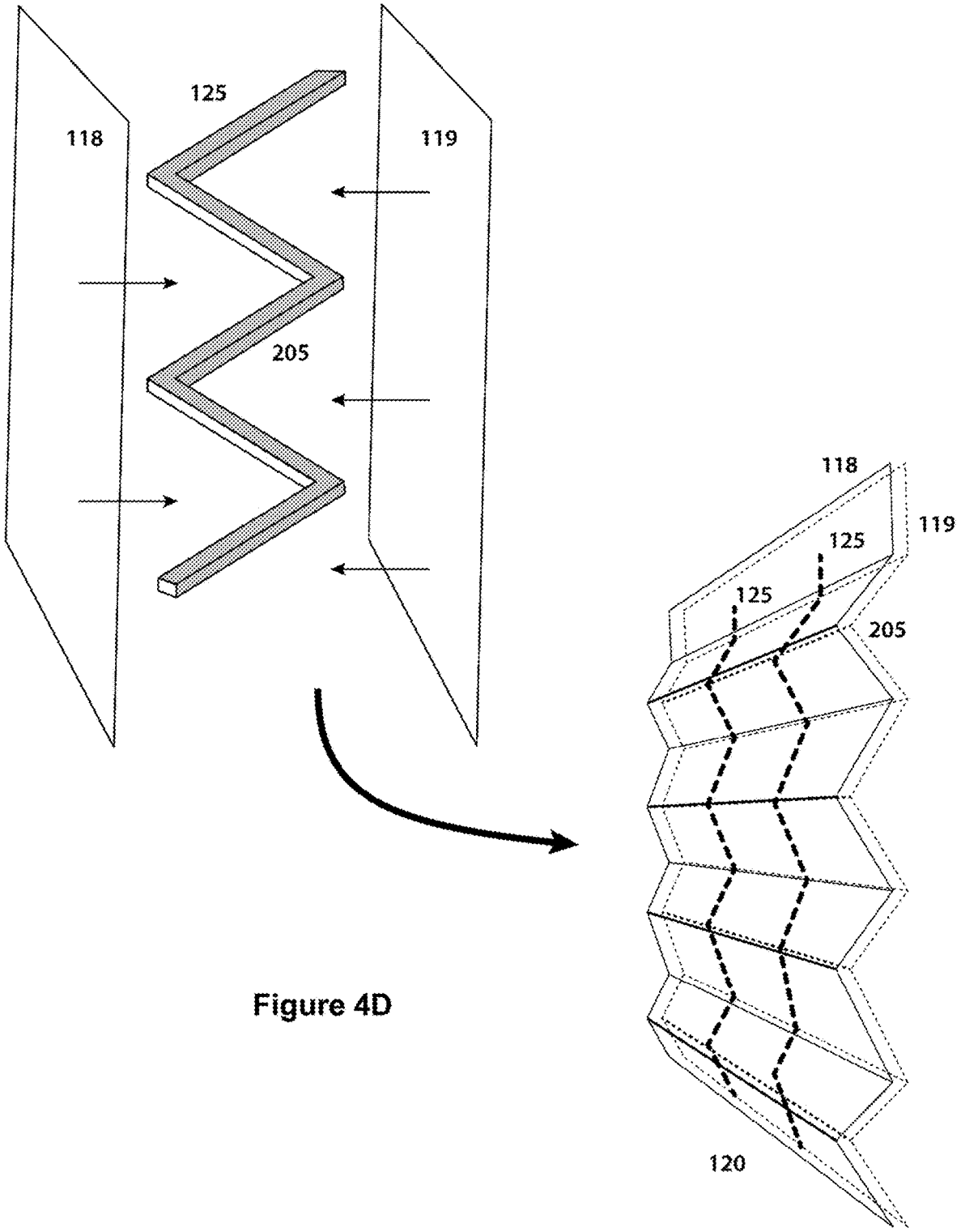

FIGS. 4A-4D illustrate this aspect of the invention with respect to a one-dimensional pleating spacer. FIG. 4A illustrates the embodiment in which a one-dimensional pleating spacer (125) is integrally positioned or affixed to a filter. For simplicity, only a single one-dimensional pleating spacer (125) is shown in the assembly of the pleated filter, however, as shown in the illustration of the assembled pleated filter, more than one such support will preferably be employed. The one-dimensional pleating spacer (125) is a rigid or semi-rigid support that has been formed into a pleat-forming shape (205), so that when integrally positioned or affixed to the filter materials (120), the filter adopts the shape of the support (125), and comprises the desired pleats. FIG. 4B and FIG. 4C illustrate the embodiment from different views. FIG. 4D illustrates an alternative embodiment in which a one-dimensional pleating spacer (125) is integrally positioned or affixed to the filter by being positioned between two filter materials (118 and 119) that are then fixed to one another. For simplicity, only a single one-dimensional pleating spacer (125) is shown in the assembly of the pleated filter, however, more than one such support will preferably be employed (as shown in the illustration of the assembled pleated filter). The one-dimensional pleating spacer (125) is a rigid or semi-rigid support that has been bent, molded, cast, folded, or otherwise formed, into a pleat-forming shape (205), so that when integrally positioned or affixed to the filter materials (119), the filter materials adopt the shape of the support (125), and form the desired pleated filter (120).

Figure 5A:
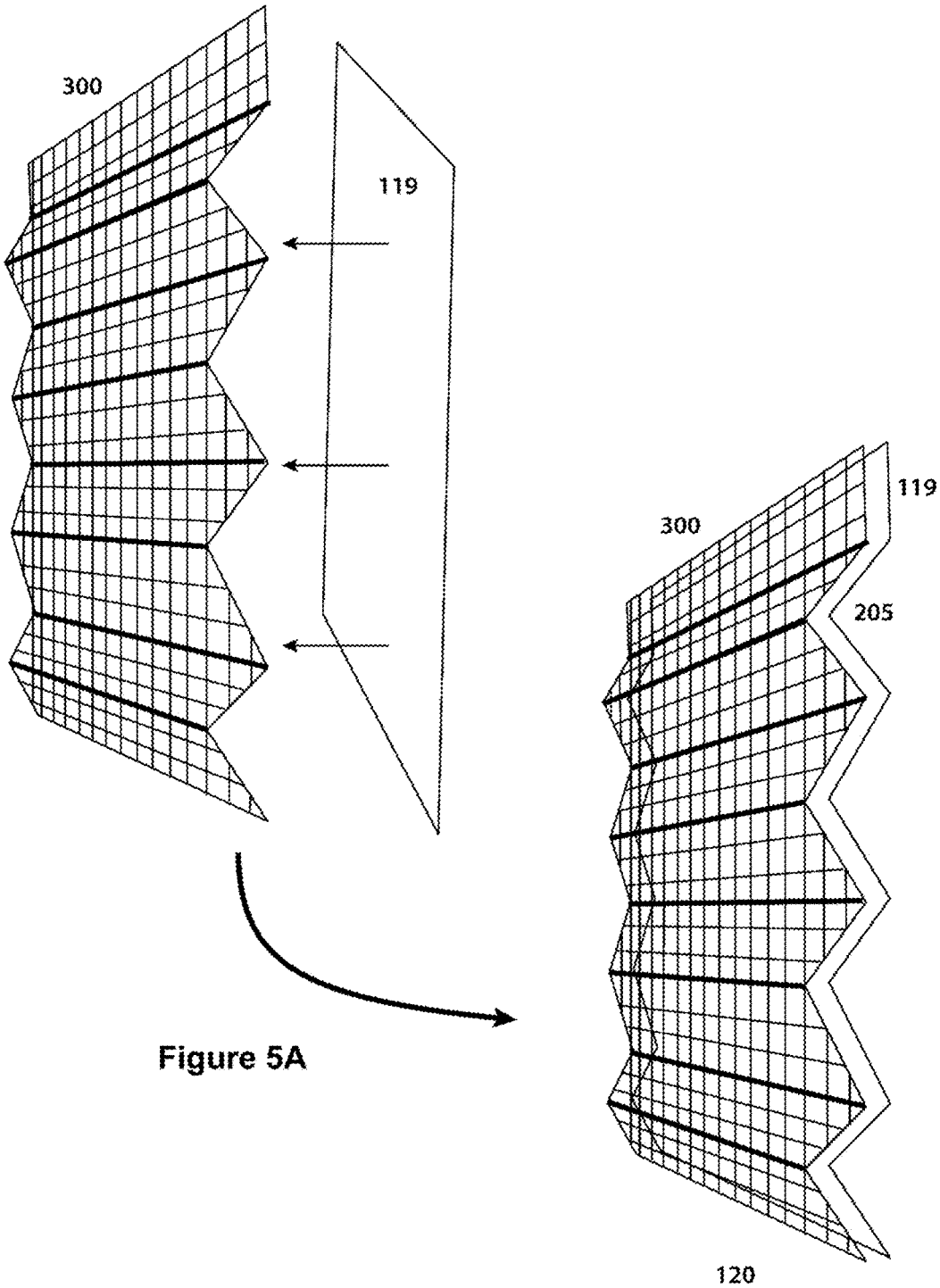
FIGS. 5A-5D illustrate the use of a two-dimensional pleating spacer to form a pleated filter from an initially unpleated filter.
Figure 5B:
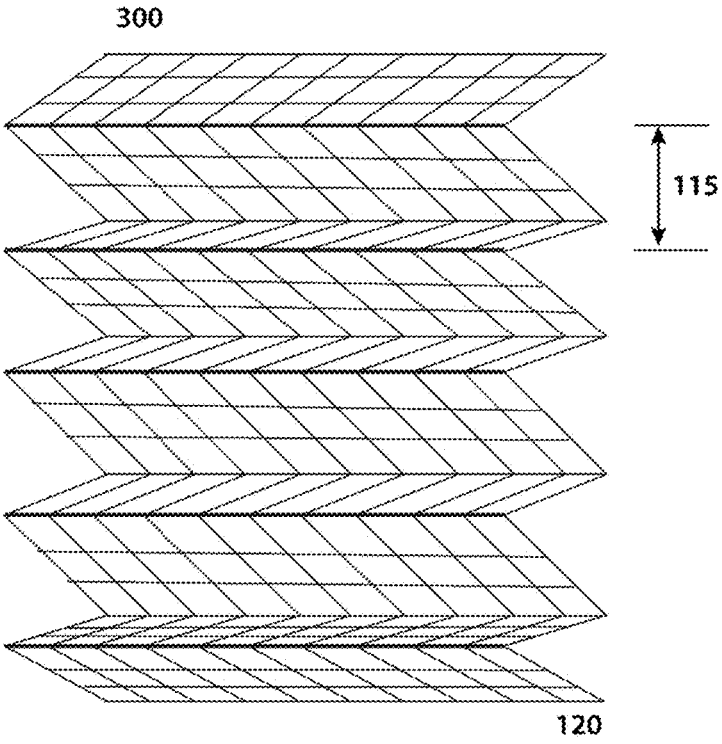
Figure 5C:
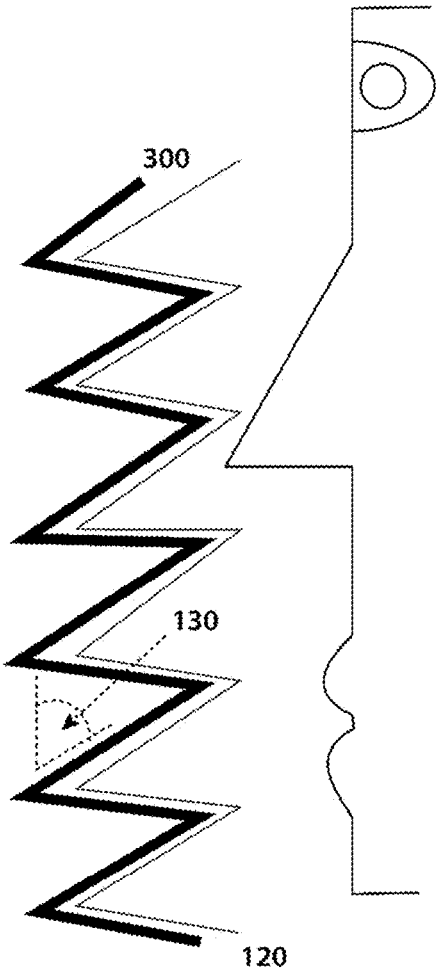
Figure 5D:
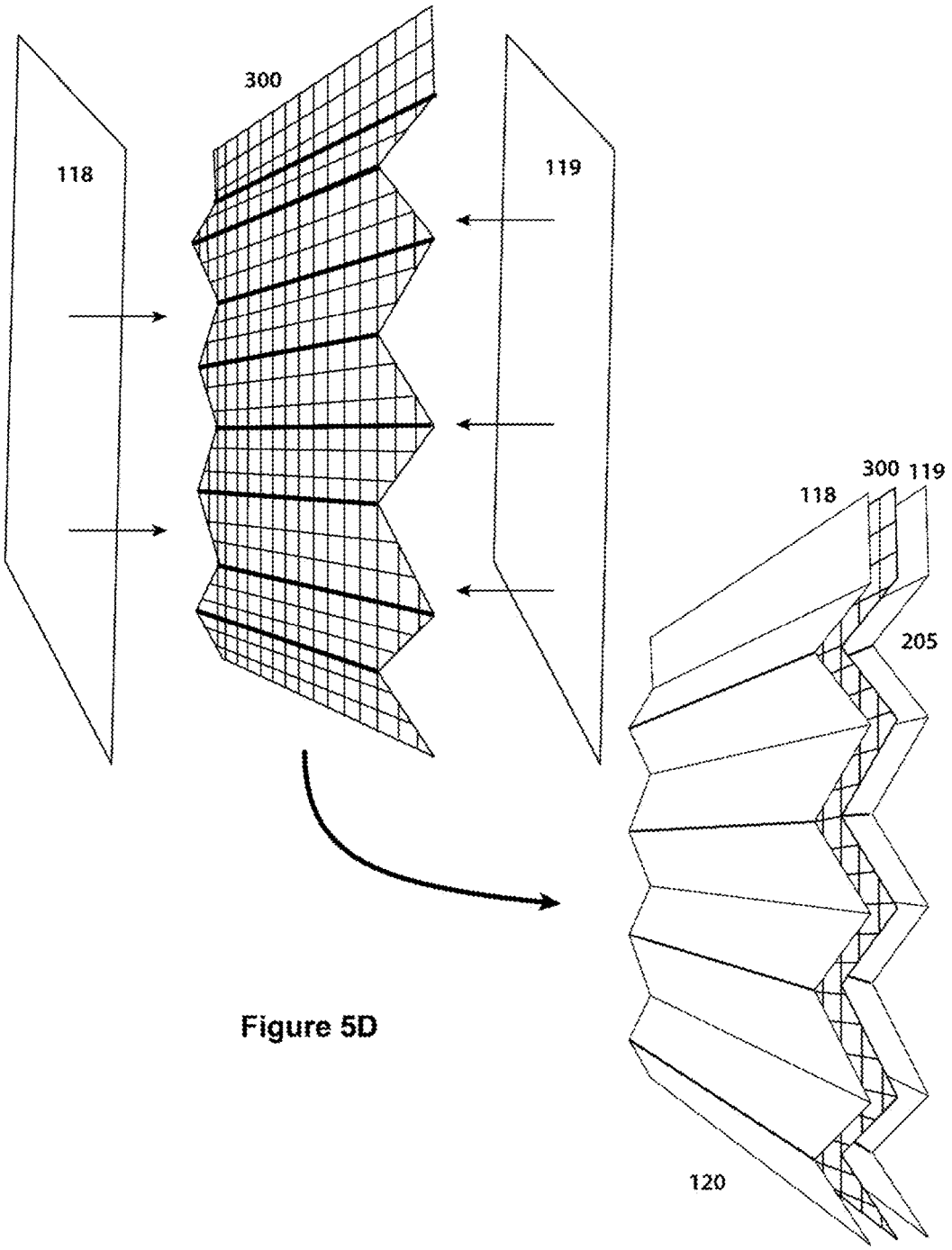

FIGS. 5A-5D illustrate this aspect of the invention with respect to a two-dimensional pleating spacer. FIG. 5A illustrates the embodiment in which a two-dimensional pleating spacer (300), shown as a mesh, is integrally positioned or affixed to the filter. Typically, only a single two-dimensional pleating spacer (300) is employed per filter, however additional one-, two-, or three-dimensional pleating spacer(s) may be employed, as desired. As illustrated in FIG. 5A, the two-dimensional pleating spacer (300) is a rigid or semi-rigid mesh support possessing openings. The spaces in the mesh facilitate airflow through the filter. The two-dimensional pleating spacer (300) has been formed into a pleat-forming shape (305), so that when integrally positioned or affixed to the filter material (119), the filter material adopts the shape of the support (300), and forms the desired pleated filter (120). FIG. 5B and FIG. 5C illustrate the embodiment from different views. FIG. 5D illustrates an alternative embodiment in which a two-dimensional pleating spacer (300) is integrally positioned or affixed to the filter by being positioned between two filter materials (118 and 119) that are then fixed to one another. The one-dimensional pleating spacer (125) is a rigid or semi-rigid support that has been bent, molded, cast, folded, or otherwise formed, into a pleat-forming shape (305), so that when integrally positioned or affixed to the filter materials (118 and 119), the filter materials (118 and 119) adopt the shape of the support (300), and form the desired pleated filter (120).

III. Preferred Respirators of the Present Invention

Preferred respirators of the present invention comprise a respirator body adapted to be placed over the face or a wearer. The respirator body comprises a solid support that comprises an opening, having an internal edge (i.e., the edge closest to the face of the wearer) and an opposing external edge (i.e., the edge furthest from the wearer), that allows air communication between the external edge of the opening and the mouth and/or nose of the wearer. The external edge of the body preferably comprises a receiver adapted to mate with and removably secure a pleated filter insert (described above). As used herein, a receiver is said to be "adapted to mate" or be a "mating receiver" of a filter insert if such components are adapted to be stably connected to one another, for example by friction fit, screw threads, snaps or fasteners, etc. Preferably the filter inserts of the present invention are adapted to mate with the receiver on the external edge of the body by possessing coordinated and interlocking screw threads. Preferably, at least some of the fold separators of the pleating spacer of the removeable and/or repositionable pleated filter insert are inserted into pleats of the pleated filter of the insert.

In preferred embodiments, the internal edge of the body (i.e., the edge closest to the wearer) is preferably fitted with a flexible, and pressure deformable, gasket that is adapted to press against the face of the wearer, achieving the desired tight fitting air seal of the respirator between an internal edge of said body and the wearer's face, when the respirator body is secured against the wearer's face by a fastening strap, tie, loop or adhesive. The gasket may be fabricated from rubber, an elastomeric material, or any other suitable gasketing material.

The body is preferably fabricated from semi-rigid plastic. The opening may have any suitable geometry, such as circular, triangular, rectangular, etc., so that the filter and/or filter insert may be circular, triangular, rectangular, etc.. A circular opening is preferred.

Figure 6A:
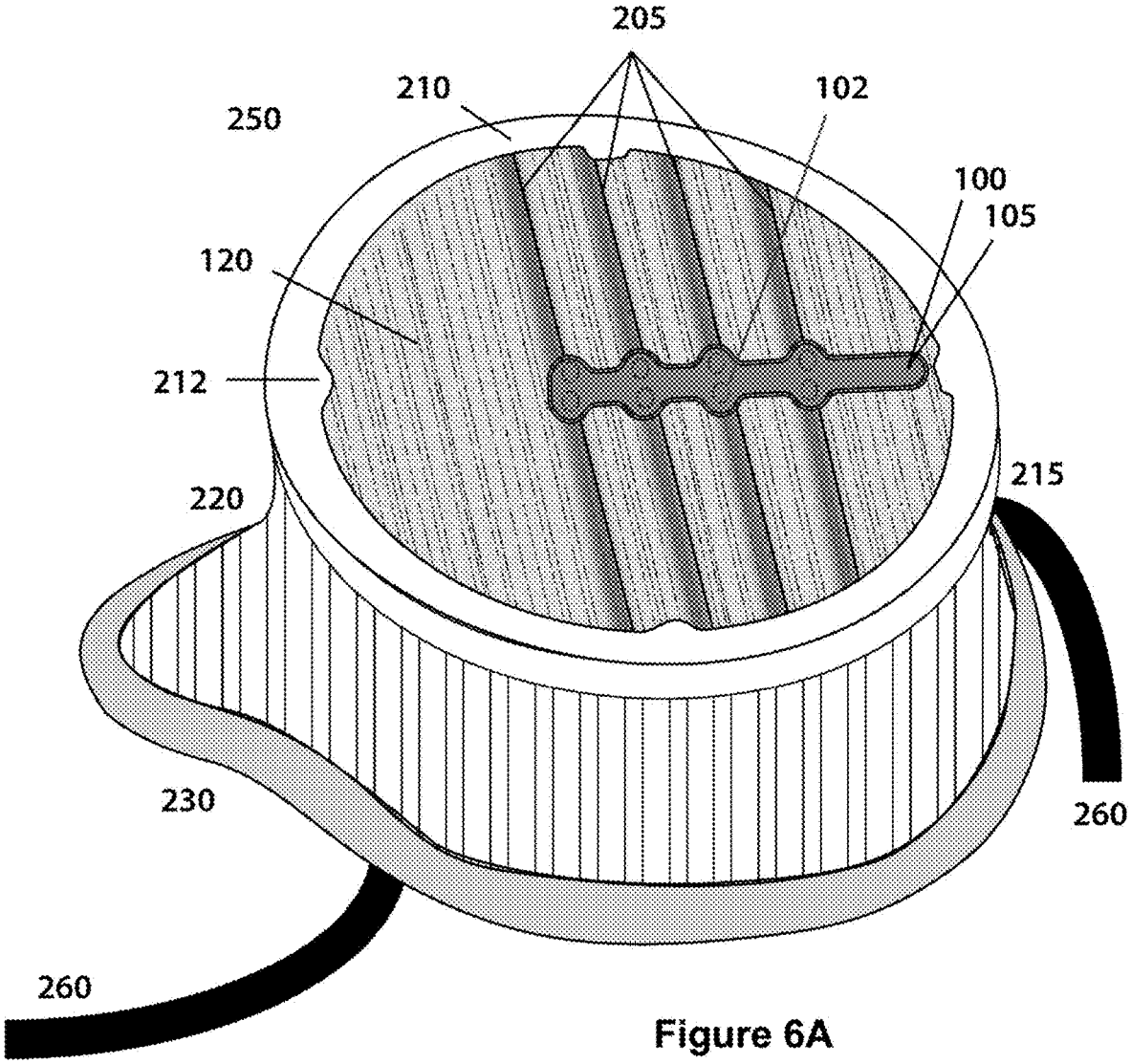
FIGS. 6A-6B illustrate preferred respirators of the present invention.
Figure 6B:
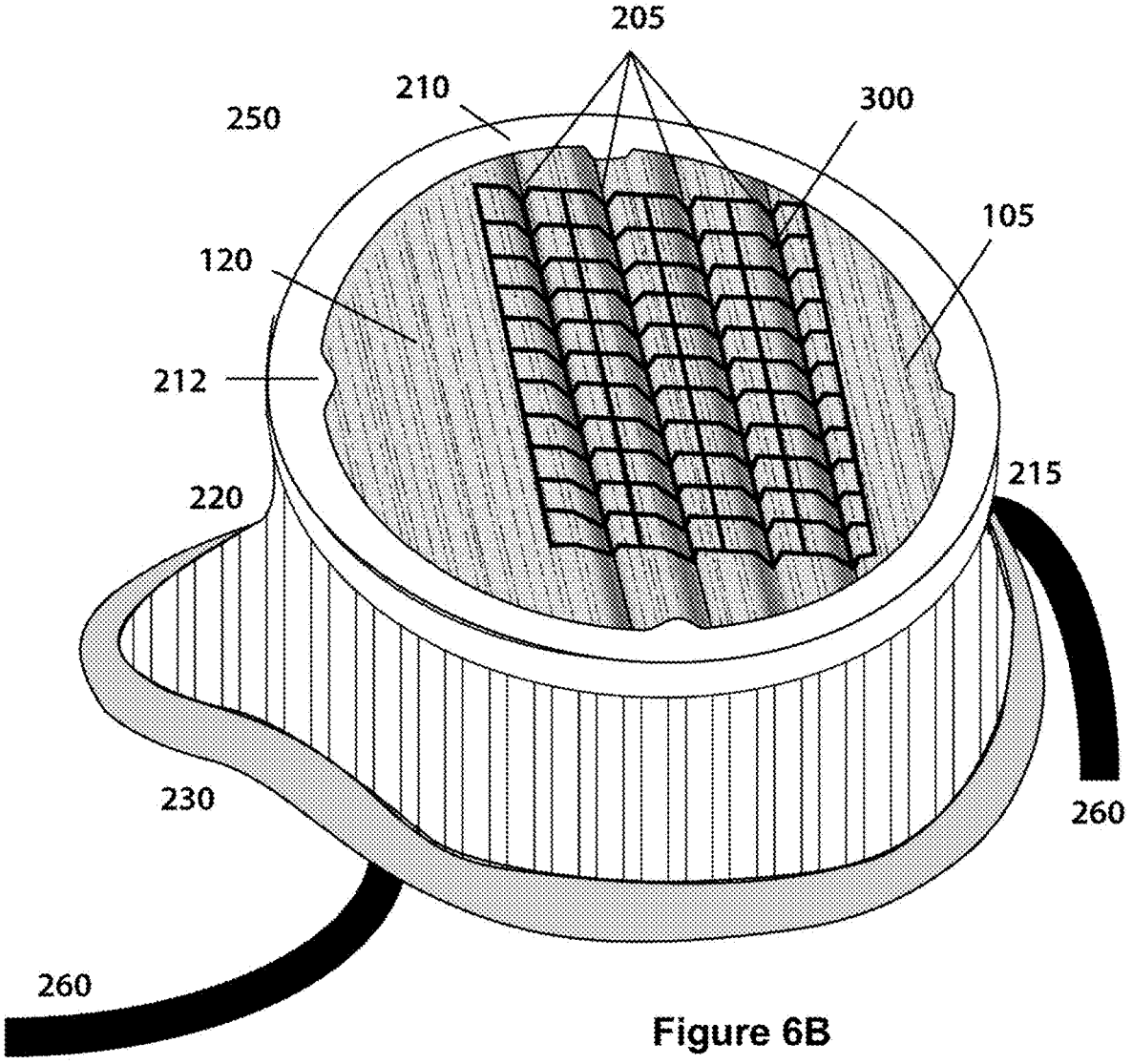

FIG. 6A illustrates a preferred respirator of the present invention that employs a removeable and/or repositionable pleating spacer to stabilize the pleats of a pre-pleated filter. FIG. 6B illustrates a preferred respirator of the present invention that employs an integrally positioned or affixed pleating spacer (shown as a mesh) to form pleats in an initially unpleated filter. The respirator (250) comprises a body (220) having an opening that allows air communication through the top of the body to the mouth and/or nose of the wearer. In FIGS. 6A and 6B, the opening is covered by the above-described pleated filter or filter layer (120), which is mated thereto, resting on a annular filter support ring (215), and locked in place by a locking ring (210) that covers the edges of the filter and engages with the filter support ring (215). The locking ring may optionally comprise tabs (212) or crossbars that serve to further prevent movement of the pleated filter or filter layer (120). The end of the body closest to the wearer is fitted with a flexible, and pressure deformable, gasket (230) that is adapted to achieve the tight fitting desired of the respirator body when pressed against the wearer's face using fastener (260) to maintain such pressure. The fold separators of a pleating spacer of the present invention (100) are pressed into the pleat folds (205) of the pleated filter or filter layer, thereby securing the pleating spacer (100) to the pleated filter or filter layer (120) and increasing the effective surface area of the filter layer.

Respirator filters and filter layers having an incorporated pleating spacer of the present invention are particularly suitable for use in forming N95™ (or N99™) respirator masks, and are thus capable of filtering at least 95% (or at least 99%) of airborne particles being inhaled or exhaled across the filter. As discussed above, one deficiency of existing N95™ (or N99™) respirators is their adverse impact on breathability, which limits the duration of their desired use (Rosner, E. (2020) "*Adverse Effects of Prolonged Mask Use among Healthcare Professionals during COVID-19*," J. Infect. Dis. Epidemiol. 6:130:1-5).

Because the pleating spacers of the respirators of the present invention are capable of stably separating the folds of pleated respirator filters, they serve to increase the effective surface area of the filter through which air is capable of flowing in normal use and at normal pressure without the need to increase the overall size of device. This attribute enhances the breathability of the respirator, and permits its continuous use for up to 1 hour, more preferably up to 3 hours, and still more preferably for 8 hours or longer. The use of a pleating spacer placed between the pleats of a filter or filter layer will hold the pleats open and prevents them from folding on each other. This will allow increased airflow.

All publications and patents mentioned in this specification are herein incorporated by reference to the same extent as if each individual publication or patent application was specifically and individually indicated to be incorporated by reference in its entirety. While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features hereinbefore set forth.

What is claimed is:

1. A pair of pleating spacers of adapted for use in a respirator or facial mask that comprises a filter, or a filter layer thereof, that comprises more than two externally-facing pleats and more than two internally-facing pleats wherein:

(A) each of said pleating spacers comprises an array of fold separators that extend outwardly from a spacer support backbone; and (B) (1) the fold separators of the first of said pair of pleating spacers is adapted to permit their removable insertion into said externally-facing pleats of said pleated filter, or said filter layer thereof; and (2) the fold separators of the second of said pair of pleating spacers is adapted to permit their removable insertion into said internally-facing pleats of said pleated filter, or said filter layer thereof;

wherein said insertion of said fold separators of said pair of pleating spacers stabilize the folds of said externally-facing pleats and said internally-facing pleats, and increases airflow through the respirator or facial mask in normal use and at normal pressure.

2. A filter insert of a respirator or facial mask, wherein said filter insert comprises a pleated filter or filter layer comprising more than two pleats, an external pleating spacer, an internal pleating spacer, and a filter support, wherein:

(A) said pleats are substantially completely folded, wearer-repositionable, pleats that are substantially planar with the filter or filter layer; and (B) said external pleating spacer and said internal pleating spacer each comprises an array of fold separators that extends outwardly from a spacer support backbone, wherein each of said fold separators is adapted to permit its insertion into a pleat of said pleated filter or filter layer; and wherein:

two or more of said pleats are disposed between, or are adapted to be disposed between, either an inserting fold separator of said external pleating spacer or an inserting fold separator of said internal pleating spacer, such that each of said pleats is stabilized by said insertion;

(ii) said external pleating spacer and said internal pleating spacer are each removeable and repositionable from said respirator or facial mask;

(iii) said pleated filter or filter layer is affixed to said filter support, which is adapted to mate to a receiving opening of said respirator or facial mask;

wherein said pleating spacers increase airflow through said respirator or facial mask, when affixed with said filter insert, in normal use and at normal pressure.

3. The filter insert of claim 2, wherein said fold separators of said external pleating spacer and said internal pleating spacer are prongs or springs that comprise a first and second end, of which only one end is attached to said pleating spacer.

4. The filter insert of claim 2, wherein said fold separators of said external pleating spacer and said internal pleating spacer are loops that comprise a first and second end, both of which are attached to said pleating spacer.

5. The filter insert of claim 2, wherein said fold separators of said external pleating spacer and said internal pleating spacer comprise a spiral, tubular, conical, or polyhedron shape.

6. The pleating spacer of claim 1, wherein, said pleating spacer comprises a rigid or semi-rigid support that is integrally positioned and/or affixed to said filter or filter layer, wherein said support comprises a preformed pleat-forming shape, and wherein the integral positioning and/or affixing of said pleating spacer causes said filter to form at least some of the pleats of said pleated filter.

7. The pleating spacer of claim 6, wherein said rigid or semi-rigid support comprises a one-dimensional support.

8. The pleating spacer of claim 7, wherein said one-dimensional support comprises a flat, tubular, or polyhedric support.

9. The pleating spacer of claim 6, wherein said rigid or semi-rigid support comprises a two-dimensional support.

10. The pleating spacer of claim 9, wherein said two-dimensional support comprises a mesh, screen, hole-containing surface, or sheet.

11. A pleated filter of a respirator or facial mask, comprising pleats that are caused by the integral positioning and/or affixing of the pleating spacer of claim 6.

12. The filter insert of claim 2, wherein said external and internal pleating spacers thereof comprises plastic, a rigid or semi-rigid foam, nylon, Teflon®, rubber or a rubber copolymer, cardstock, paper, wood, silicone, or metal.

13. The filter insert of claim 2, wherein said pleated filter thereof is capable of filtering at least 95% of airborne particles being inhaled or exhaled across the filter.

14. The filter insert of claim 2, wherein said pleated filter thereof is composed of multiple discreet layers.

15. The filter insert of claim 2, wherein said pleated filter thereof, or a filter layer thereof, comprises an antimicrobial compound.

16. The filter insert of claim 2, wherein said pleated filter thereof is composed of at least one layer of a non-woven polypropylene fabric.

17. A respirator or facial mask, that comprises a respirator body adapted to be placed over the face or a wearer, wherein said respirator body comprises the filter insert of claim 2.

18. The respirator or facial mask of claim 17, wherein:

(a) said body comprises a solid support that comprises an opening having an internal edge and an opposing external edge;

(b) said opening of said body allows air communication between said external edge of said opening and the mouth and/or nose of the wearer; and (c) said filter insert is removably mounted into a mating receiver on said external edge of said opening.

19. The respirator or facial mask of claim 17, wherein said internal edge of said body is fitted to a gasketing layer capable of forming an air seal between an internal edge of said body and said wearer's face.

* * * * *